US007168795B2

(12) United States Patent
Shimizu

(10) Patent No.: US 7,168,795 B2
(45) Date of Patent: Jan. 30, 2007

(54) INK JET RECORDING APPARATUS

(75) Inventor: Yoichiro Shimizu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 253 days.

(21) Appl. No.: 10/996,947

(22) Filed: Nov. 24, 2004

(65) Prior Publication Data

US 2005/0117000 A1 Jun. 2, 2005

(30) Foreign Application Priority Data

Nov. 28, 2003 (JP) ..... 2003-400470

(51) Int. Cl.
*B41J 2/17* (2006.01)

(52) U.S. Cl. ..... 347/84

(58) Field of Classification Search ..... 347/84–87
See application file for complete search history.

(56) References Cited

U.S. PATENT DOCUMENTS

| | | | | |
|---|---|---|---|---|
| 5,369,429 | A * | 11/1994 | Erickson | 347/7 |
| 6,033,064 | A * | 3/2000 | Pawlowski et al. | 347/87 |
| 6,582,067 | B2 * | 6/2003 | Matsuzaki et al. | 347/85 |
| 6,729,717 | B2 | 5/2004 | Ito et al. | |
| 2002/0196316 | A1 | 12/2002 | Nakamura | |
| 2003/0151649 | A1 | 8/2003 | Matsuzaki et al. | |

FOREIGN PATENT DOCUMENTS

| | | |
|---|---|---|
| EP | 1284190 | 2/2003 |
| JP | 2000-309109 | 11/2000 |
| JP | 2001-219560 | 8/2001 |
| JP | 2002-067312 | 3/2002 |
| JP | 2002-240310 | 8/2002 |

* cited by examiner

*Primary Examiner*—An H. Do
(74) *Attorney, Agent, or Firm*—Pitney Hardin LLP

(57) ABSTRACT

An ink jet recording apparatus including a recording head having nozzles; an ink-tank supporting portion which supports ink tanks; ink-tank-side fluid flow channels which connect the ink tanks to the recording head and include ink supply tubes; buffer tanks provided between the ink supply tubes and the recording head; a discharging device which discharges a fluid from each of the buffer tanks into an outside space; and discharging-device-side fluid flow channels which communicate, at respective one ends thereof, with the buffer tanks, respectively, while bypassing the recording head, and communicate, at respective other ends thereof, with the discharging device. A first one of the discharging-device-side fluid flow channels that communicates with a first one of the ink-tank-side fluid flow channels has a liquid flow resistance smaller than a liquid flow resistance of a second one of the discharging-device-side fluid flow channels that communicates with a second one of the ink-tank-side fluid flow channels that has a liquid flow resistance greater than a liquid flow resistance of the first ink-tank-side fluid flow channel.

15 Claims, 20 Drawing Sheets

FIG.18A
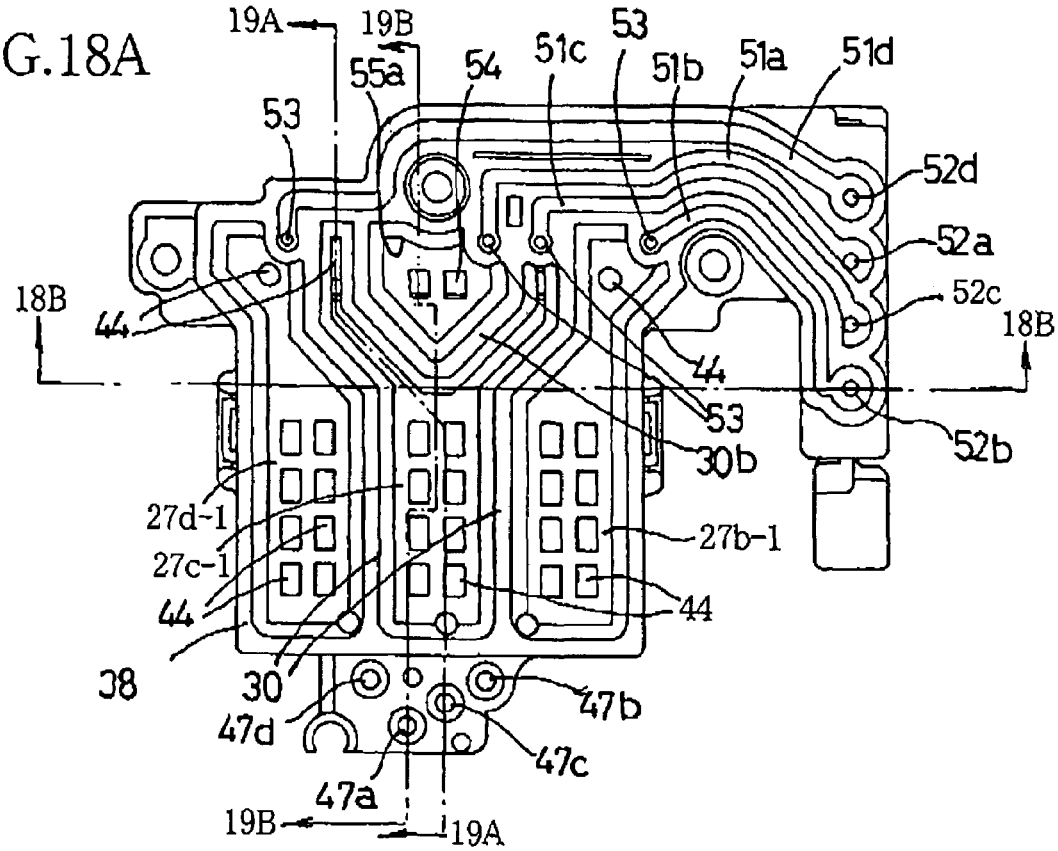
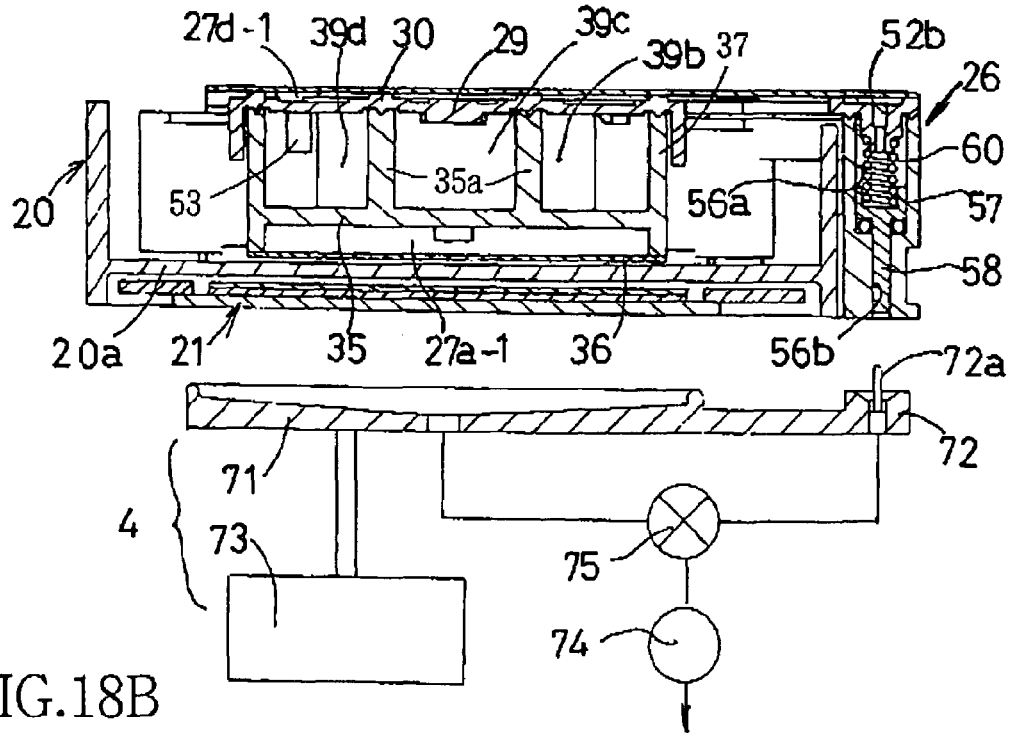
FIG.18B

INK JET RECORDING APPARATUS

The present application is based on Japanese Patent Application No. 2003-400470 filed on Nov. 28, 2003, the contents of which are incorporated herein by reference.

BACKGROUND OF THE INVENTION

1. Field of the Invention

The present invention relates to an ink jet recording apparatus and particularly to such an ink jet recording apparatus in which ink is supplied from a plurality of stationary ink tanks to a recording head mounted on a movable carriage, via a plurality of ink supply tubes, respectively.

2. Discussion of Related Art

Patent Document 1 (Japanese Patent Application Publication P2002-240310A) or Patent Document 2 (Japanese Patent Application Publication P2000-309109A) discloses a tube-supply-type ink jet printer including a plurality of recording heads having a plurality of arrays of nozzles, respectively, that eject, for recording a full-color image, a plurality of color inks, respectively, such as a black ink (BK), a cyan ink (C), a yellow ink (Y), and a magenta ink (M); a plurality of buffer tanks that accommodate respective amounts of the corresponding color inks, and air bubbles; a movable carriage that is movable relative to a housing and on which the recording heads and the buffer tanks are mounted; a plurality of stationary ink tanks that store the color inks, respectively, and are disposed in the housing; and a plurality of flexible ink supply tubes that supply the color inks from the ink tanks to the buffer tanks, respectively.

In the above-indicated conventional ink jet printer, air in the atmosphere dissolves little by little into the color inks through respective walls of the ink supply tubes, and the air dissolving in the color inks develops little by little into air bubbles in the ink supply tubes and/or the buffer tanks. Therefore, each of the buffer tanks collects the air bubbles in an upper portion thereof so as to prevent the air bubbles from entering a corresponding one of the recording heads. When respective pre-set amounts of air bubbles are collected in the buffer tanks, an air discharging pump is operated to discharge the air bubbles from the buffer tanks via respective air discharging passages that are connected to the respective upper portions of the buffer tanks.

Meanwhile, if, when an ink jet recording apparatus is shipped from a factory, a plurality of ink flow channels including a plurality of ink supply tubes, a plurality of buffer tanks, and a plurality of recording heads, respectively, are full of air, air bubbles may be left in the ink flow channels of the new ink jet recording apparatus when a user initially fills those channels with a plurality of color inks, respectively. Thus, the new apparatus may fail to eject the inks. To prevent this problem, it is usually practiced to fill, before the ink jet recording apparatus is shipped from the factory, each of the ink flow channels with a maintenance liquid (e.g., a liquid having a basically same composition as that of an ink but not containing a coloring agent) and liquid-tightly seal, with a sealing member, a free end of a corresponding one of the ink supply tubes that is to be connected to a corresponding one of a plurality of ink tanks.

Thus, when the user purchases the new ink jet recording apparatus and starts using the apparatus, i.e., initially introduces the apparatus, the user needs to connect, according to a user's manual, the respective free ends of the ink supply tubes to the corresponding ink tanks, then move a maintenance unit, provided at a waiting position in the housing, so as to contact closely respective nozzle supporting surfaces of the recording heads, and operate the maintenance unit to discharge the maintenance liquid from the ink flow channels and fill those channels with the color inks supplied from the ink tanks. However, this method suffers such a problem that small ink flow passages provided in the recording heads exhibit a great resistance to flow of the maintenance liquid and accordingly the color inks cannot be quickly supplied from the ink tanks to the ink flow channels including the buffer tanks.

SUMMARY OF THE INVENTION

Hence, there is known an ink jet recording apparatus in which an air discharging pump connectable to a plurality of air discharging passages connected to respective upper portions of a plurality of buffer tanks is operated to discharge a maintenance liquid from a plurality of ink flow channels including the buffer tanks and fill those channels with a plurality of color inks, respectively, and subsequently a maintenance unit is operated to discharge the maintenance liquid from a plurality of recording heads and fill those heads with the color inks, respectively.

Meanwhile, recently there has been a demand for such a full-color ink jet recording apparatus that can record a monochromatic image at a high speed. To this end, the recording apparatus needs to eject a black ink in a greater amount than respective amounts in which it ejects other color inks.

To meet the above-indicated demand, it is preferred to employ a black ink supply tube having a greater cross section area than those of other ink supply tubes, so that the black ink supply tube can supply the black ink in a greater amount per unit time than respective amounts in which the other color ink supply tubes can supply the other color inks.

However, in the case where all the ink supply tubes have a same length and all the buffer tanks have a same volume, respective amounts of maintenance liquid charged in the ink supply tubes are in proportion to respective cross section areas of the tubes. Therefore, it when a user initially introduces the ink jet recording apparatus, the maintenance liquid is discharged simultaneously from the ink flow channels via respective air discharging passages connected to respective upper portions of the buffer tanks, and if all the air discharging passages discharge a same amount of the maintenance liquid per unit time, first of all, the maintenance liquid present in the ink flow channel including the ink supply tube having the smallest cross section area is fully discharged and is replaced with a certain color ink, and some amounts of the maintenance liquid remain in the other ink flow passages having the greater cross section areas. Therefore, when the maintenance liquid present in the other ink flow channels including the ink supply tubes having the greater cross section areas are wholly discharged and are replaced with certain color inks, respectively, some amount of the color ink will have been uselessly discharged as a waste ink from the ink flow channel including the ink supply tube having the smallest cross section area.

In addition, there is known a full-color ink jet recording apparatus that employs, for recording frequently a monochromatic image, a black ink tank having a greater volume and other color ink tanks having respective smaller volumes. When a user initially introduces this apparatus, only small amounts of the other color inks than the black ink may be left in the other color ink tanks than the black ink tank, when a maintenance liquid is fully discharged from an ink flow channel corresponding to the black ink. This means that the recording apparatus can only record, with the left small amounts of the other color inks, small amounts of full-color images on recording media such as recording sheets, and that the running cost of the apparatus is increased.

It is therefore an object of the present invention to provide an ink jet recording apparatus which is free from at least one of the above-identified problems.

According to the present invention, there is provided an ink jet recording apparatus, comprising a recording head which has a plurality of nozzles and which ejects, from each of the nozzles, a droplet of a corresponding one of a plurality of sorts of inks to form an image; an ink-tank supporting portion which supports a plurality of ink tanks which store the inks, respectively, such that the ink tanks are stationary; a plurality of ink-tank-side fluid flow channels which connect the ink tanks to the recording head, respectively, and include a plurality of ink supply tubes, respectively, which supply the inks from the ink tanks to the recording head, respectively, a plurality of buffer tanks which are provided between the ink supply tubes and the recording head and each of which accommodates a corresponding one of the inks, and air bubbles; a discharging device which discharges a fluid from each of the buffer tanks into an outside space; and a plurality of discharging-device-side fluid flow channels which communicate, at respective one ends thereof, with the buffer tanks, respectively, while bypassing the recording head, and communicate, at respective other ends thereof with the discharging device. The plurality of ink-tank-side fluid flow channels comprise first and second ink-tank-side fluid flow channels having respective first liquid flow resistances different from each other. The plurality of discharging-device-side fluid flow channels comprise first and second discharging-device-side fluid flow channels having respective second liquid flow resistances different from each other. The first discharging-device-side fluid flow channel that communicates with the first ink-tank-side fluid flow channel has the second liquid flow resistance smaller than the second liquid flow resistance of the second discharging-device-side fluid flow channel that communicates with the second ink-tank-side fluid flow channel that has the first liquid flow resistance greater than the first liquid flow resistance of the first ink-tank-side fluid flow channel.

The present ink jet recording apparatus may further comprise a control device which controls, in a first operation mode thereof, the discharging device to discharge, for a first predetermined time duration, the air bubbles from each of the buffer tanks into an outside space via a corresponding one of the discharging-device-side fluid flow channels, and controls, in a second operation mode thereof the discharging device to discharge, for a second predetermined time duration longer than the first time duration, not only the air bubbles but also a liquid (e.g., a maintenance liquid) from the each buffer tank into the outside space via the corresponding discharging-device-side fluid flow channel.

If, when a user initially introduces the ink jet recording apparatus in accordance with the present invention, the discharging device simultaneously starts discharging a liquid such as a maintenance liquid from one ink supply tube corresponding to one sort of ink, e.g., a black ink (BK), that is ejected in a greater amount per unit time, and the other ink supply tube or tubes corresponding to the other sort or sorts of color ink or inks (C, Y, M) that is or are ejected in a smaller amount or amounts per unit time, one discharging-device-side fluid flow channel corresponding to the black ink can discharge the liquid in a greater amount per unit time than the amount or amounts in which the other discharging-device-side fluid flow channel or channels corresponding to the other color ink or inks can discharge the liquid, so that the operation of replacing the liquid in all the ink supply tubes and the buffer tanks with the corresponding color inks can be simultaneously ended. Thus, the present ink jet recording apparatus is freed of the problem of the conventional ink jet recording apparatus that replacing the maintenance liquid in the black ink flow channel with the black ink is ended after replacing the maintenance liquid in the other color ink flow channel or channels with the other color ink or inks is ended, and accordingly some amount or amounts of the other color ink or inks is or are uselessly discharged from the other color ink flow channel or channels.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which:

FIG. 18A is a plan view of the upper case of FIG. 16A;

FIG. 18B is a cross-section view taken and viewed along arrows indicated by 18B, 18B in FIG. 18A;

DETAILED DESCRIPTION OF THE PREFERRED EMBODIMENTS

Figure 1:
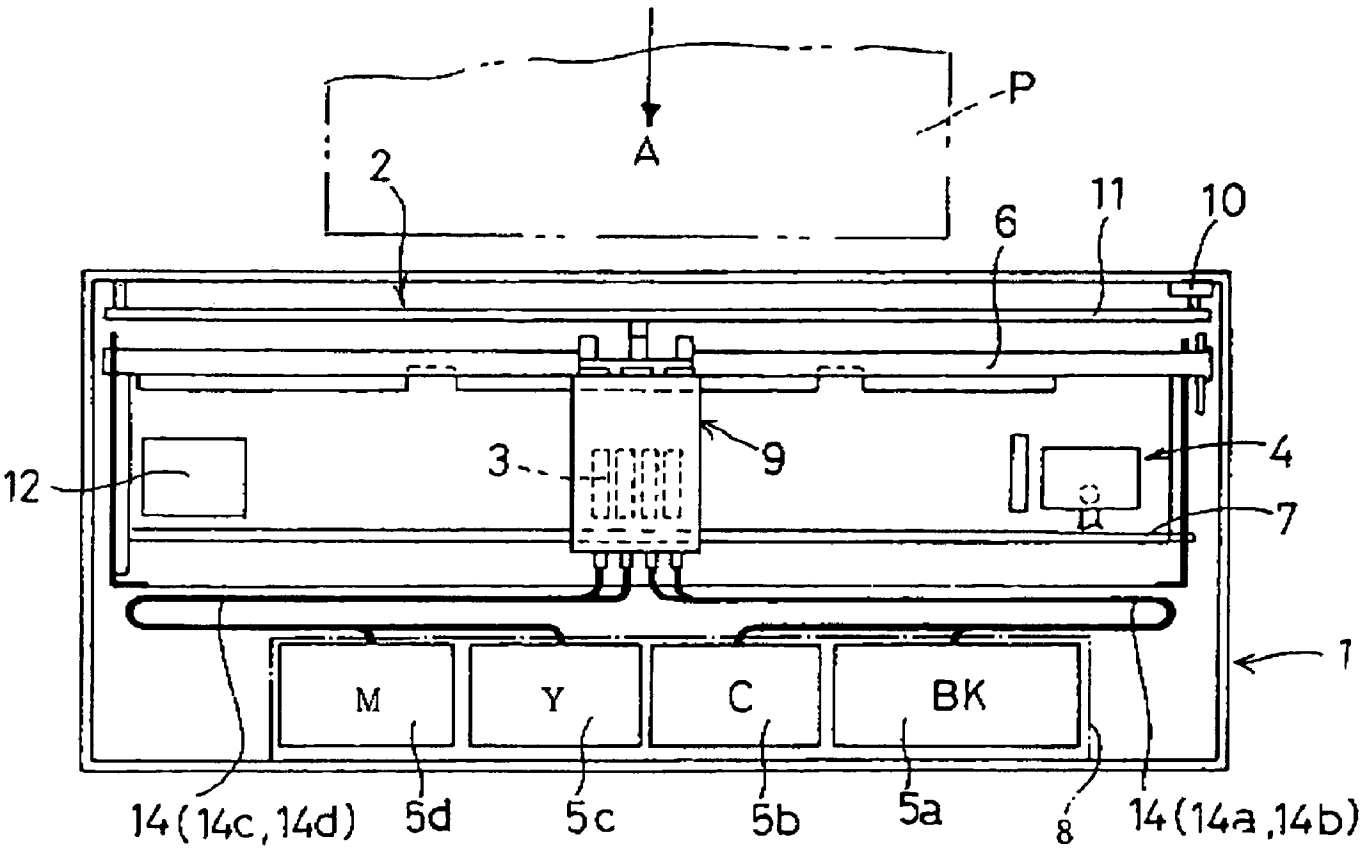
FIG. 1 is a plan view of an ink jet printer as a first embodiment of the present invention.

Hereinafter, there will be described a preferred embodiment of the present invention by reference to the drawings. As shown in FIG. 1, an ink jet printer (i.e., an ink jet recording apparatus) as an embodiment of the present invention includes a recording portion 2, a maintenance unit 4, and four ink tanks 5 (5*a*, 5*b*, 5*c*, 5*d*) each of which is detachably attached to an ink-tank supporting member 8 fixed to a housing 1. The recording portion 2 is incorporated in the housing 1, and includes a recording head unit 3 that ejects droplets of color inks toward a recording sheet P as a sort of recording medium so as to print or record images (e.g., characters, symbols, etc.) thereon. The maintenance unit 4 performs maintenance of the recording head unit 3. The four ink tanks 5 store respective different color inks to be supplied to the recording head unit 3.

The four ink tanks 5*a*, 5*b*, 5*c*, 5*d* store, for recording a full-color image on the recording sheet P, a black ink (BK), a cyan ink (C), a yellow ink (Y), and a magenta ink (M), respectively. When the ink stored in each of the ink tanks 5 is used out, a user can replace the each ink tank 5 with a new one,.

In the recording portion 2, a rear guide bar 6 and a front guide bar 7 are provided such that the two guide bars 6, 7 are elongate in a lengthwise direction of the housing 1 and extend parallel to each other; and a carriage 9 rests on the two guide bars 6, 7, such that the carriage 9 is movable relative the housing 1. The recording head unit 3 is integrally mounted on the carriage 9.

A carriage drive motor 10, provided in a rear, right corner of the housing 1, and an endless timing belt 11 cooperate with each other to reciprocate the carriage 9 on the front and rear guide bars 7, 6 in the lengthwise direction of the housing 1. A well-known sheet feeding device, not shown, feeds the recording sheet P such that the sheet P passes in its horizontal posture under a lower surface of the recording head unit 3, in a direction, indicated by arrow "A" in FIG. 1, that is perpendicular to the directions in which the carriage 9 is reciprocated.

At an ink flushing position located in one of opposite side areas outside the width of the recording sheet P being fed (i.e., the left-hand side area shown in FIG. 1), an ink collecting portion 12 is provided; and, at a head waiting position located in the other side area (i.e., the right-hand side area shown in FIG. 1), the maintenance unit 4 is provided. During a recording operation of the ink jet printer, the recording head unit 3 is periodically moved to the ink flushing position where the head unit 3 is controlled to eject inks to prevent clogging of nozzles 22 (22*a*, 22*b*, 22*c*, 22*d*, FIG. 2) of the head unit 3, and the ink collecting portion 12 collects the thus ejected inks.

Figure 3:
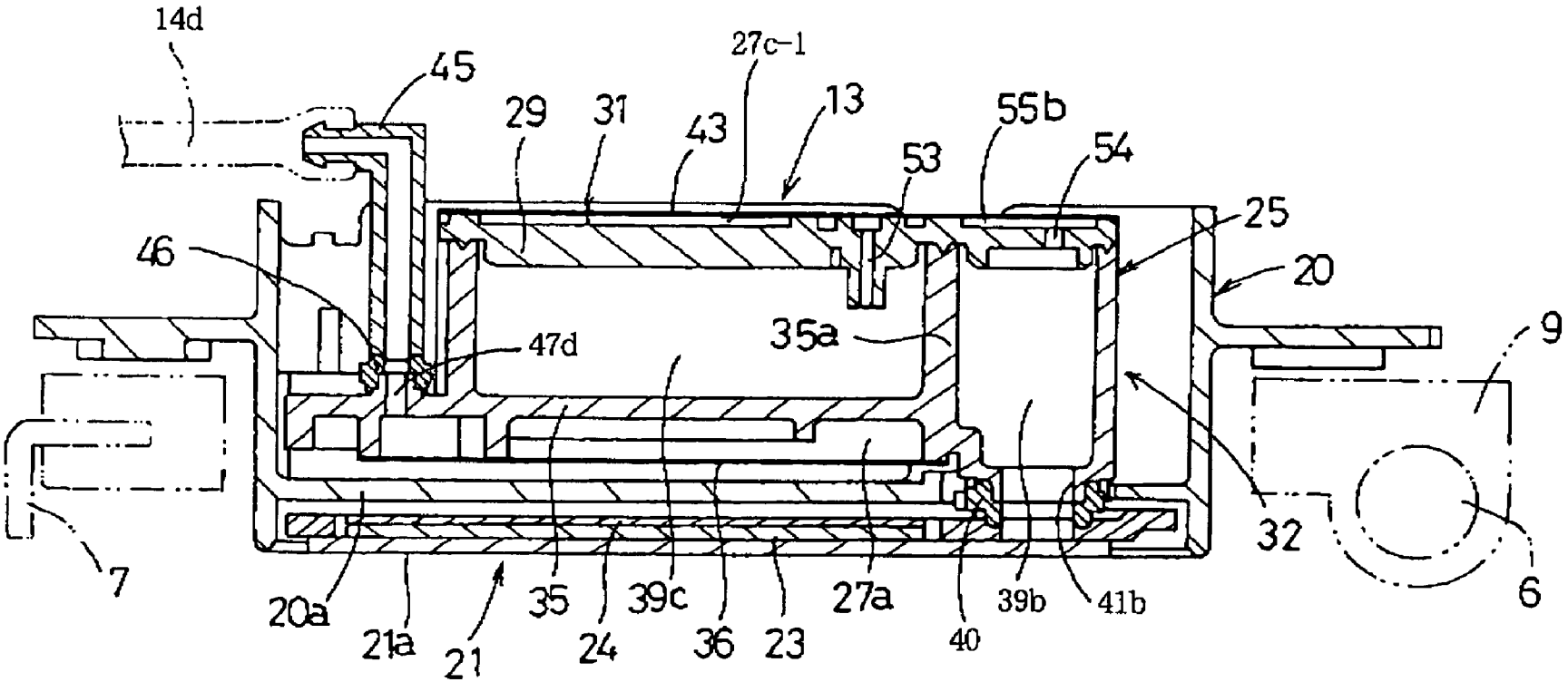
FIG. 3 is a cross-section view taken and viewed along arrows indicated by 3, 3 in FIG. 2.

When a user purchases a new ink jet printer and starts using the printer, i.e., when the user initially introduces the printer, the user needs to carry out the following operations according to a user's manual: First, the four ink tanks 5*a*, 5*b*, 5*c*, 5*d* storing the four color inks, respectively, are connected to respective upstream-side ends of four flexible ink supply tubes 14 (14*a*, 14*b*, 14*c*, 14*d*), and then a suction pump (i.e., a discharging pump) 74 (FIG. 8A) of the maintenance unit 4 is driven, at the head waiting position, to discharge, by suction, respective amounts of maintenance liquid from the four ink supply tubes 14 and four buffer chambers 27, described later, and charge the tubes 14 and the chambers 27 with the corresponding color inks, respectively. In addition, usually, a suction cap 71 of the maintenance unit 4 is moved upward to contact closely a lower surface (i.e., a nozzle supporting surface) 21*a* (FIG. 3) of a recording head 21 of the recording head unit 3, and discharge, by suction, the maintenance liquid remaining in ink supply channels of the recording head 21 while charging those channels with the color inks. Moreover, the maintenance unit 4 is periodically operated to perform a recovering operation to suck the color inks from the recording head 21, and a removing operation to remove air bubbles (i.e., air) from a buffer device 13 (FIG. 3).

At a height position lower than the lower surface of the recording head unit 3, i.e., the nozzle supporting surface 21*a* (FIG. 3) of the recording head 21, each of the four ink tanks 5 can be inserted, in a direction from the front side to the rear side, into a corresponding one of four ink-tank holding portions of the ink-tank supporting member 8. As shown in FIG. 1, the black ink (BK) tank 5*a*, the cyan ink (C) tank 5*b*, the yellow ink (Y) tank 5*c*, and the magenta ink (M) tank 5*d* are arranged in an array along a straight line in the order of description in a direction from the right-hand side, to the left-hand side, while each tank 5 takes a horizontal posture.

Each of the four ink-tank holding portions of the ink-tank supporting member 8 has an ink supply hollow needle, not shown, that projects horizontally from a rear wall of the supporting member 8, in a frontward direction opposite to the direction in which a corresponding one of the four ink tanks 5 is inserted. Respective base end portions of the four hollow needles are connected to the recording head 21 via the respective highly flexible ink supply tubes 14*a*, 14*b*, 14*c*, 14*d*. Respective intermediate portions of the black ink supply tube 14*a* and the cyan ink supply tube 14*b* are superposed on each other and are bound together; and respective intermediate portions of the yellow ink supply tube 14*c* and the magenta ink supply tube 14*d* are superposed on each other and are bound together,.

Next, the recording head unit 3 mounted on the carriage 9 will be described by reference to FIGS. 2 through 8C. In the present embodiment, the full color image recording head unit 3 includes a head holder 20, the ink jet recording head 21, the buffer device 13, and an opening and closing valve device 26 as portion of a discharging device that additionally includes the suction pump 74 and a switch valve (i.e., a control valve) 75. The head holder 20 has a box-like configuration. The recording head 21 is fixed to a lower surface of a bottom wall 20*a* of the head holder 20, and the buffer device 13 is fixed to an upper surface of the bottom wall 20*a*.

Figure 2:
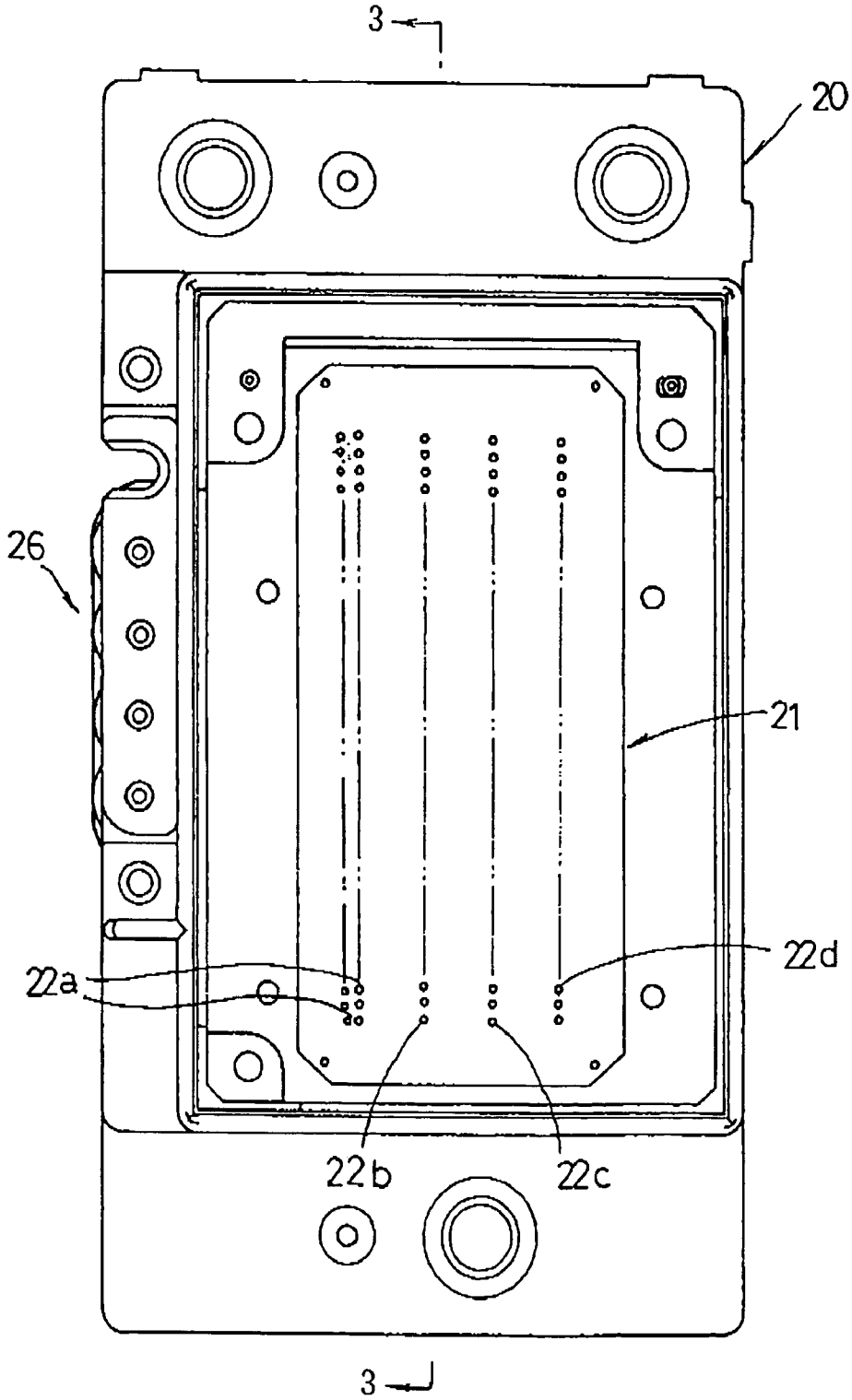
FIG. 2 is a bottom view of a recording head, and a head holder, of the ink jet printer.

The recording head 21 includes four recording head portions that correspond to the four color inks, respectively, and are integrally arranged in an array. FIG. 2 is a bottom view of the recording head 21. As shown in the figure, the lower surface 21*a* of the recording head 21 supports five arrays of nozzles 22*a*, 22*b*, 22*c*, 22*d* corresponding to the black ink (BK), the cyan ink (C), the yellow ink (Y), and the magenta ink (M), in the order of description, in the direction from the left-hand side to the right-hand side, such that each array of the five arrays of nozzles 22 extends in a direction perpendicular to the directions in which the carriage 9 is reciprocated. Each of the nozzles 22 opens downward to face an upper surface of the recoding sheet P. The nozzles 22*a* corresponding to the black ink are arranged in two arrays, whereas the nozzles 22*b*, 22*c*, 22*d* corresponding to each of the cyan, yellow, and magenta inks are arranged in one array. Thus, the total number of the nozzles 22*a* corresponding to the black ink is twice the total number of the nozzles 22*b*, 22*c*, 22*d* corresponding to each of the cyan, yellow, and magenta inks.

Like a known recording head disclosed by Japanese Patent Application Publication P2002-67312A (or its corresponding U.S. Pat. No. 6,729,717B2) or Japanese Patent Application Publication P2001-219560A, the recording head 21 has, in a portion of an upper surface thereof five ink supply holes, not shown, that correspond to the four color inks (two ink supply holes correspond to the black ink and three ink supply holes correspond the other, three color inks, respectively) and that communicate with the ink supply channels of the head 21. Each of the four color inks is supplied to a plurality of pressure chambers, not shown, via a corresponding one or ones of the ink supply channels. Thus, the recording head 21 has five arrays of pressure chambers corresponding to the five arrays of nozzles 22, respectively; and five arrays of actuators, such as piezoelectric elements, corresponding to the five arrays of pressure chambers, respectively. The recording head 21 ejects a droplet of ink from an arbitrary one of the nozzles 22 when a corresponding one of the pressure chambers is actuated by a corresponding one of the actuators. An actuator unit 23 includes the five arrays of piezoelectric actuators. A flexible flat cable 24 that applies an electric voltage to each of the piezoelectric actuators is fixed to an upper surface of the actuator unit 23. The four color inks are supplied from the four ink tanks 5 to the five ink supply holes of the recording head 21 via the four ink supply tubes 14 and the buffer device 13.

Next, respective constructions of the buffer device 13 and the opening and closing valve device 26 will be described in detail by reference to FIGS. 2 through 8C. The buffer device 13 has the four buffer chambers (i.e., four buffer tanks) 27 (27*a*, 27*b*, 27*c*, 27*d*) which correspond to the four color inks, respectively, and which are independent of each other. The buffer device 13 has a primary partition wall 35 and secondary partition walls 35*a*, 35*b*, 30 all of which cooperate with each other to separate the four buffer chambers 27 from each other. In the present embodiment, a portion (i.e., a first chamber) 27*a*-1 of the black ink (BK) buffer chamber 27*a* is located under the primary partition wall 35; and other portions (i.e., second and third chambers) 39*a*, 55*a* of the black ink buffer chamber 27*a*, and the cyan ink (C), yellow ink (Y), and magenta ink (M) buffer chambers 27*b*, 27*c*, 27*d* are located above the primary partition wall 35, and are separated from each other by the secondary partition walls 35*a*, 35*b*, 30. Thus, the four buffer chambers 27 are provided in two layers, i.e., upper and lower layers in the damper device 13.

More specifically described, the buffer device 13 includes a buffer case (i.e., a case unit) 25 that has a generally rectangular outer (or side) wall, and includes an upper case 31 and a lower case 32. Each of the upper case 31 and the lower case 32 is formed, by injection, of a synthetic resin. The lower case 32 has a box-like shape, and opens upward and downward; and the upper case 31 is fixed to the lower case 32 so as to close the upper open end thereof. The upper case 31 is liquid-tightly bonded by, e.g., ultrasonic welding to the lower case 32.

The lower case 32 has a lower opening that occupies a major portion of the lower open end thereof, and includes the primary partition wall 35 that is distant inward from, and is parallel to, each of the upper and lower open ends thereof. The lower open end of the lower case 32 is fluid-tightly closed by a lower flexible membrane (or diaphragm) 36 that is constituted by a thin film formed of a synthetic resin and does not allow permeation of air or liquid. The flexible membrane 36 functions as a buffer member. More specifically described, an outer periphery of the flexible membrane 36 is bonded by, e.g., adhesion or ultrasonic welding to a lower end of an outer (or side) wall 37 of the lower case 32 that defines the lower opening of the same 32. The flexible membrane 36 and the primary partition wall 35 cooperate with each other to define the first chamber 27*a*-1 of the black ink (BK) buffer chamber 27*a*. The buffer device 13 is fixed to the head holder 20, such that between the flexible membrane 36 and the bottom wall 20*a* of the head holder 20, there is left a clearance that allows an operative deformation of the flexible membrane 36.

Figure 6:
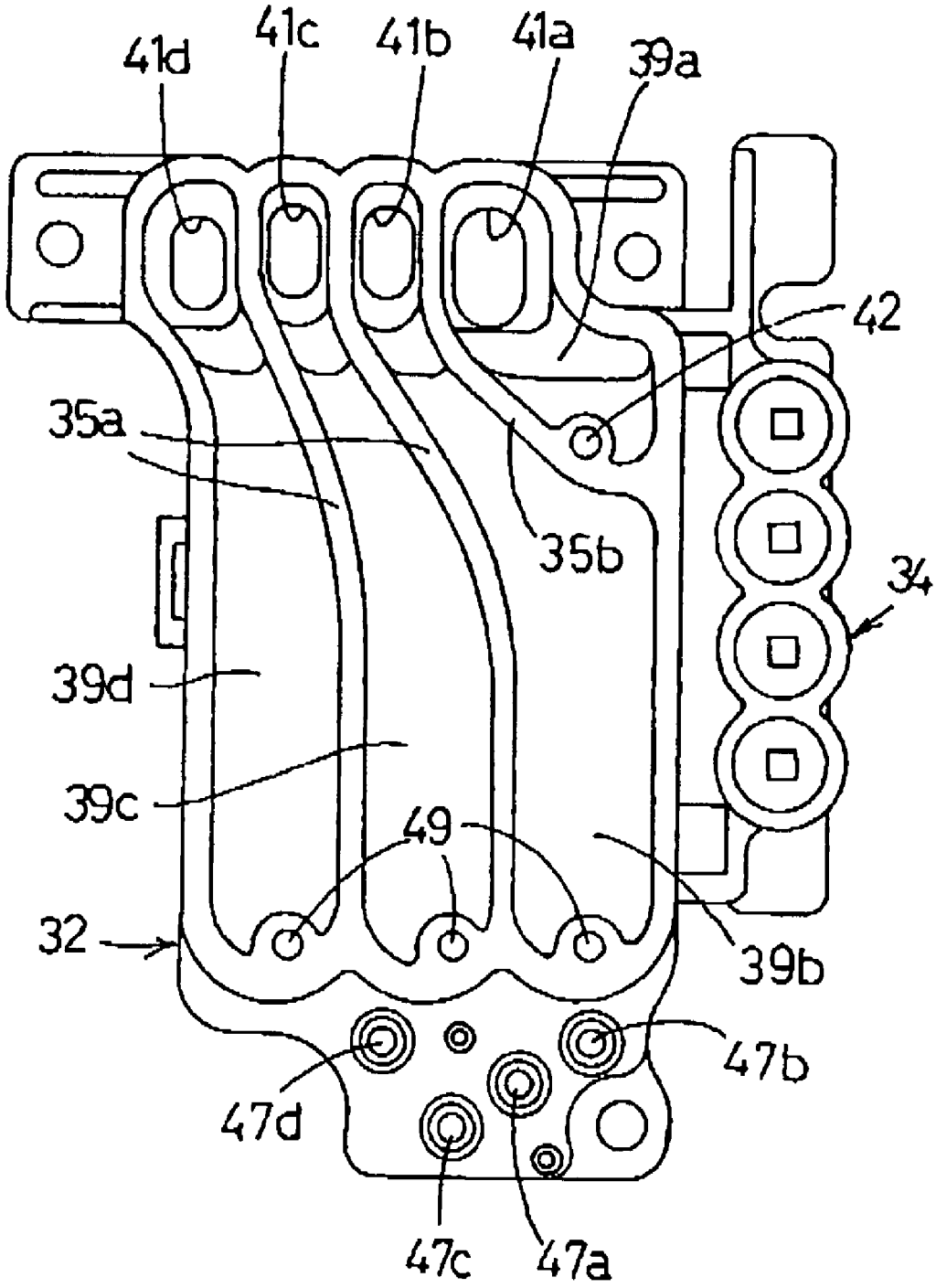
FIG. 6 is a plan view of a lower case of a buffer case (i.e., a case unit) of the buffer device.

The two secondary partition walls 35*a* and the one secondary partition wall 35*b* extend upward from the upper surface of the primary partition wall 35, as shown in FIG. 6. Thus, an upper portion of the lower case 32 that is located above the primary partition wall 35, cooperate with the upper case 31 to define respective portions (i.e., second chambers) 39 (39*a*, 39*b*, 39*c*, 39*d*) of the four buffer chambers 27. In the present embodiment, the two secondary partition walls 35*a* are distant from each other, and cooperate with the side wall 37 and the secondary partition wall 35*b* of the lower case 32 to define the respective second chambers 39*b*, 39*c*, 39*d* of the cyan ink (C), yellow ink (Y), and magenta ink (M) buffer chambers 27*b*, 27*c*, 27*d*. Respective first chambers 27*b*-1, 27*c*-1, 27*d*-1 of the cyan ink, yellow ink, and magenta ink buffer chambers 27*b*, 27*c*, 27*d* will be described later. As shown in FIG. 6, the secondary partition walls 35*a* extend horizontally over a substantially entire length of the lower case 32. The respective second chambers 39*a*, 39*c*, 39*d* of the three buffer chambers 27*b*, 27*c*, 27*d* communicate, at respective positions offset from the upper surface of the primary partition wall 35 in a horizontal direction, with respective ink flow outlets 41*b*, 41*c*, 41*d* corresponding to the cyan ink, yellow ink, and magenta ink, respectively.

The secondary partition wall 35*b* cooperates with the side wall 37 of the lower case 32 to define the second chamber 39*a* of the black ink (BK) buffer chamber 27*a*. As shown in FIG. 6, the secondary partition wall 35*b* extends horizontally to a position that is horizontally offset from the upper surface of the primary partition wall 35 and is near to the ink flow outlets 41*b*, 41*c*, 41*d*, and the second chamber 39*a* communicates with an ink flow outlet 41*a* corresponding to the black ink.

Figure 5:
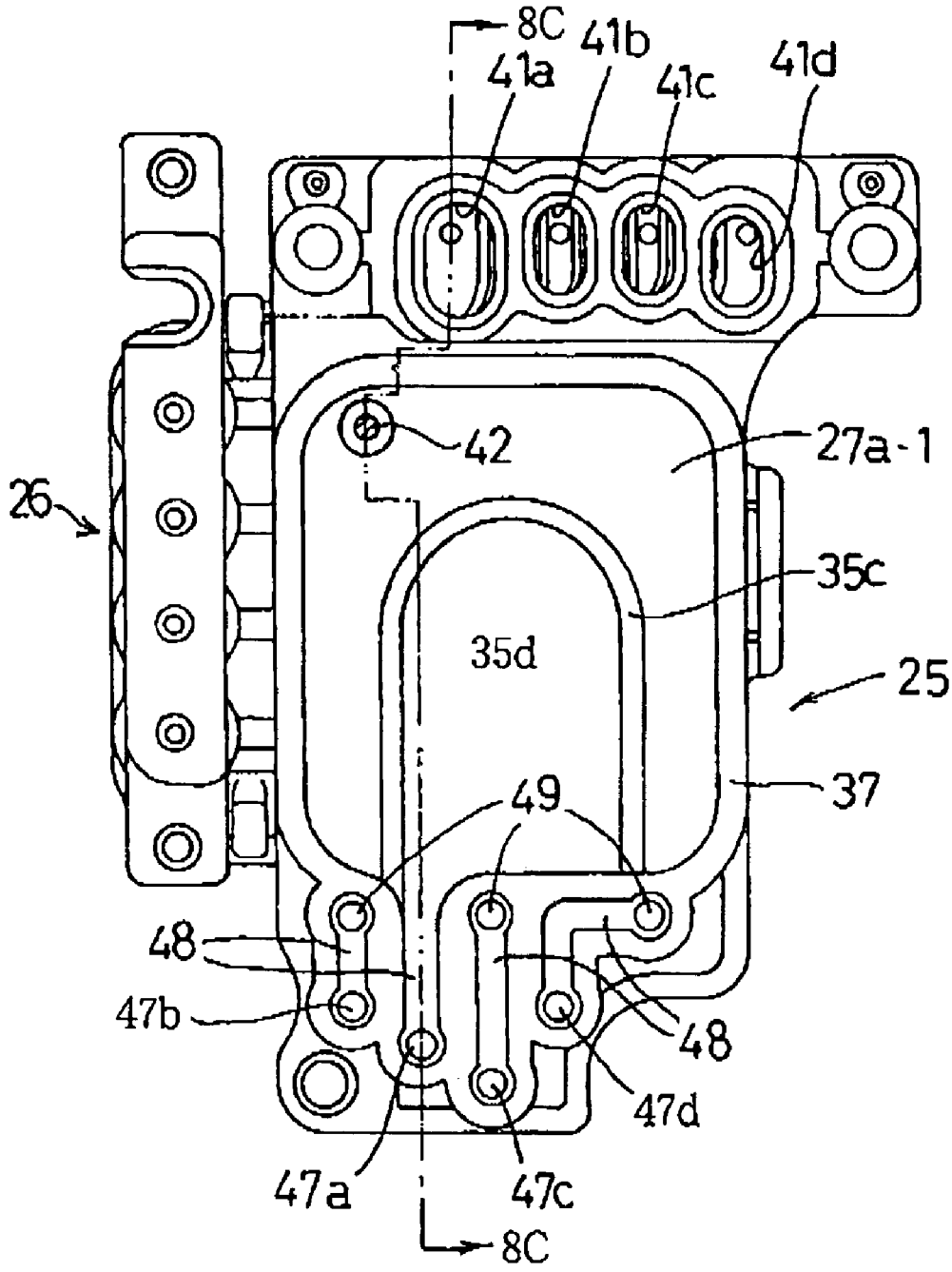
FIG. 5 is a bottom view of the buffer device, with a lower flexible membrane thereof being removed.
Figure 8A:
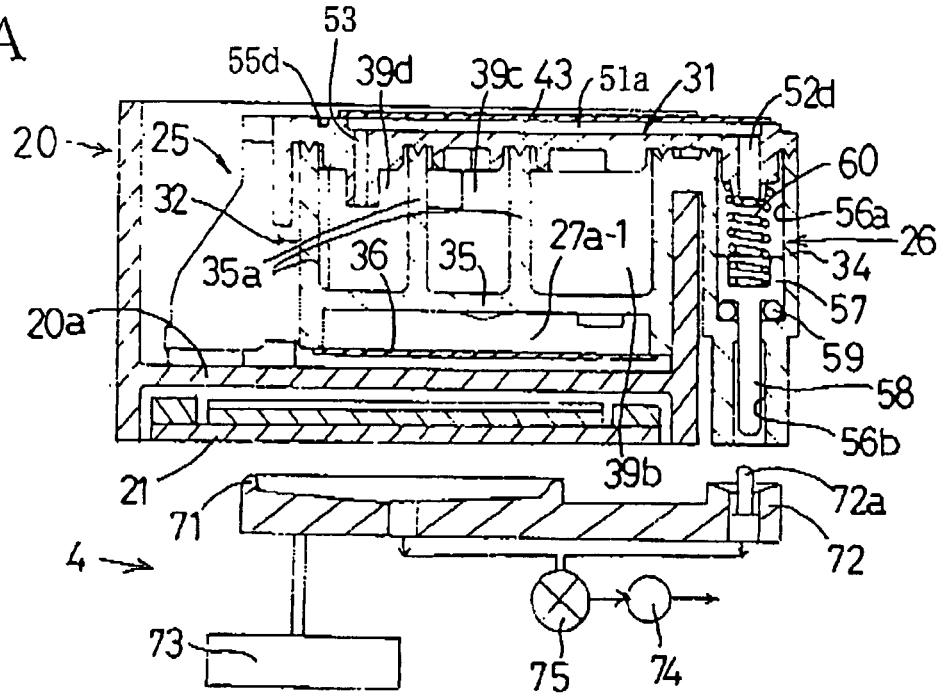
FIG. 8A is a cross-section view taken and viewed along arrows indicated by 8A, 8A in FIG. 4.
Figure 8B:
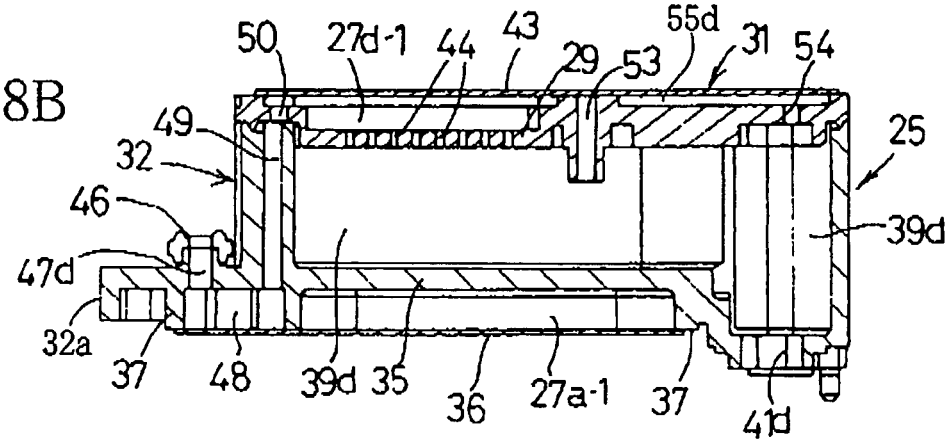
FIG. 8B is a cross-section view taken and viewed along arrows indicated by 8B, 8B in FIG. 4.
Figure 8C:
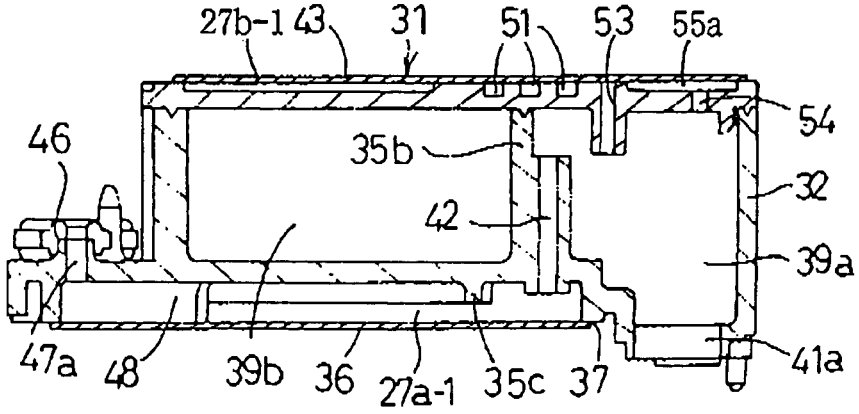
FIG. 8C is a cross-section view taken and viewed along arrows indicated by 8C, 8C in FIG. 5.

The first chamber 27*a*-1 of the black ink (BK) buffer chamber 27*a* communicates with the second chamber 39*a* thereof, via an ink flow passage 42 that is vertically formed through a cylindrical wall formed along the secondary partition wall 35*b*, as shown in FIGS. 5, 6, and 8C. The ink flow passage 42 functions as a flow restricting portion. The ink flow passage 42 has a smaller cross-section area than that of the first chamber 27*a*-1, and accordingly has a greater resistance to flow of liquid (e.g., ink or maintenance liquid) therethrough than that of the same 27*a*-1.

Figure 4:
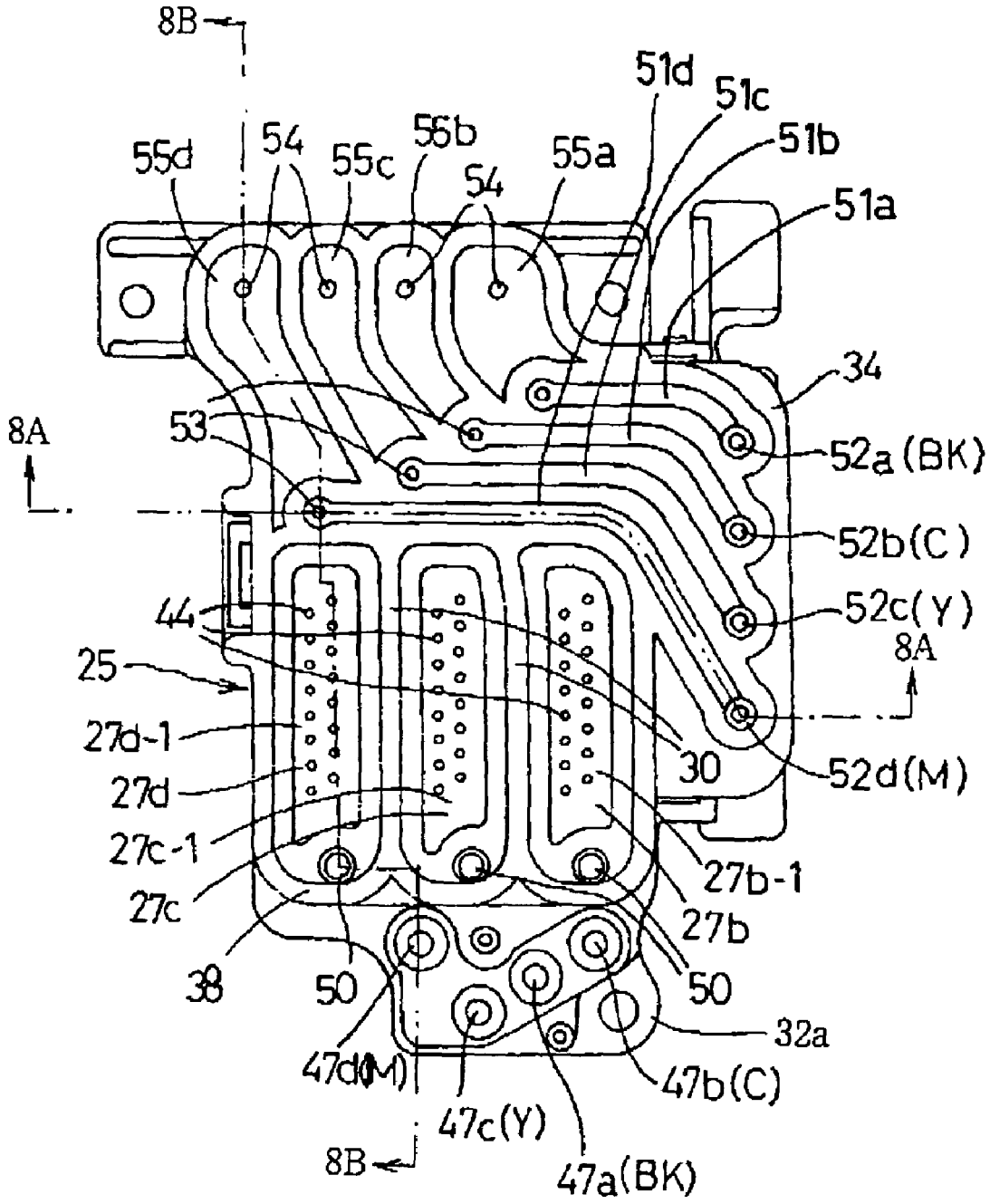
FIG. 4 is a plan view of a buffer device of the ink jet printer, with an upper flexible membrane of the buffer device being removed.

The upper case 31 has a generally flat configuration, and has a plurality of recesses formed in an upper surface thereof. As shown in FIG. 4, the upper case 31 has, on the upper side thereof the two secondary partition walls 30 that cooperate with each other to separate respective portions (i.e., first chambers) 27*b*-1, 27*c*-1, 27*d*-1 of the cyan ink (C), yellow ink (Y), and magenta ink CM) buffer chambers 27*b*, 27*c*, 27*d*, from each other. The three first chambers 27*b*-1, 27*c*-1, 27*d*-1 are substantially aligned with, and located above, the first chamber 27*a*-1 of the black ink (BK) buffer chamber 27*a* that opens downward, and the three first chambers 27*b*-1, 27*c*-1, 27*d*-1 open upward. The two secondary partition walls 30 of the upper case 31 are partly located on respective planes vertically extending from the two secondary partition walls 35*a* of the lower case 32. A lid portion 29 of the upper case 31 defines respective bottom walls of the three first chambers 27*b*-1, 27*c*-1, 27*d*-1, and has a plurality of communication holes 44 vertically formed through a thickness of the lid portion 29. Each of the holes 44 may have a circular cross section having a diameter of about 0.8 mm, or a square cross section having each side of about 0.8 mm. The communication holes 44 cooperate with each other to function as a flow restricting portion, like the ink flow passage 42. Thus, each of the three first chambers 27*b*-1, 27*c*-1, 27*d*-1 communicates, via corresponding ones of the communication holes 44, with a corresponding one of the three second chambers 39*b*, 39*c*, 39*d* that are located below the three first chambers 27-1, respectively, and are defined by the secondary partition walls 35*a* within the lower case 32.

Each of the communication holes 44 has a smaller cross-section area than that of each of the three first chambers 27*b*-1, 27*c*-1, 27*d*-1, and accordingly has a greater resistance to flow of liquid therethrough than that of the same 27*b*-1, 27*c*-1, 27*d*-1.

Respective upper openings of the three first chambers 27*b*-1, 27*c*-1, 27*d*-1 are commonly closed by a single upper flexible membrane 43 that is constituted by a film formed of a synthetic resin and does not allow permeation of air or liquid. The flexible membrane 43 functions as a buffer member. More specifically described, an outer periphery of the upper flexible membrane 43 is bonded by, e.g., adhesion or ultrasonic welding to an upper end of an outer (or side) wall 38 of the upper case 31 that defines respective outer peripheries of the three first chambers 27*b*-1, 27*c*-1, 27*d*-1, and to respective upper ends of the secondary partition walls 30 of the same 31.

As shown in FIG. 5, the four ink flow outlets 41*a*, 41*b*, 41*c*, 41*d* are arranged in an array in the lower surface of the lower case 32, and open downward at a height position lower than a height position where the lower flexible membrane 36 is provided. Meanwhile, the recording head 21 has, in the upper surface thereof, the five ink supply holes, not shown, that communicate with respective upstream-side ends of five common ink chambers, not shown, corresponding to the four color inks (two common ink chambers correspond to the black ink and three common ink chambers correspond to the other three color inks, respectively), and that are opposed to the four ink flow outlets 41, respectively. The bottom wall 20*a* of the head holder 20 has four through-holes which allow the four ink flow outlets 41 to communicate with the five ink supply holes of the recording head 21 via respective sealing members 40 such as rubber packing members.

The lower case 32 includes a flange-like projecting portion 32*a* that laterally projects from one side surface of the lower case 32 that is opposite to the ink flow outlets 41. As shown in FIGS. 3 and 4, the projecting portion 32*a* has four ink flow inlets 47 (47*a*, 47*b*, 47*c*, 47*d*) that correspond to the black ink (BK), the cyan ink (C), the yellow ink (Y), and the magenta ink (M), respectively, and each of which opens upward.

Four joint members 45 are connected to the four ink flow inlets 47, respectively, via respective sealing members 46 such as rubber packing members. Respective upstream-side ends of the four joint members 45 are connected to respective downstream-side ends of the four flexible ink supply tubes 14 corresponding to the four color inks, respectively. The four ink supply tubes 41 define respective portions of four ink-tank-side fluid flow channels that additionally include the four joint members 45 and the four ink flow inlets 47, respectively.

As shown in FIGS. 4, 5, 7A, 7B, and 8B, the ink flow inlet 47*a* corresponding to the black ink (BK) communicates with the first chamber 27*a*-1 of the black ink buffer chamber 27*a* via a connection passage 48 in the form of a horizontal groove which is formed in the lower surface of the lower case 32 and opens downward; and the other, three ink flow inlets 47*b*, 47*c*, 47*d* corresponding to the other, three color inks communicate with the respective first chambers 27*b*-1, 27*c*-1, 27*d*-1 of the other, three buffer chambers 27*b*, 27*c*, 27*d* via respective connection passages or horizontal grooves 48 which are formed in the lower surface of the lower case 32 and open downward, respective communication passages 49 vertically extending in the side wall 37 of the lower case 32 (in a direction substantially perpendicular to the primary partition wall 35), and respective communication passages 50 vertically extending in the side wall 38 of the upper case 31. Since respective upper open ends of the three communication passages 50 of the upper case 31 are located at respective height positions that are near to a lower surface of the upper flexible membrane 43, the inks flowing into the first chambers 27*b*-1, 27*c*-1, 27*d*-1 can directly collide with the flexible membrane 43 that is near, and opposed, to the respective upper open ends of the communication passages 50, so that respective dynamic changes of pressure of the inks in the flexible ink supply tubes 14*b*, 14*c*, 14*d* can be efficiently absorbed and attenuated, i.e., damped by the flexible membrane 43.

Respective lower open ends of the four ink flow inlets 47 and the four connection passages 48 are closed by an extension portion of the lower flexible membrane 36.

The primary partition wall 35 has, on the lower surface thereof defining a ceiling surface of the first chamber 27*a*-1 of the black ink (BK) buffer chamber 27*a*, a rib 35*c* having, in its plan view, a generally U-shaped configuration whose opposite ends are connected to the side wall 37 of the lower case 32 that is near to the connection passages 48. However, the rib 35*c* does not reach the lower flexible membrane 36. Therefore, the rib 35*c* defines a space 35*d* that holds an air layer and accordingly does not allow the black ink to enter itself, and the air layer held by the space 35*d* cooperates with the lower flexible membrane 36 to absorb the dynamic changes of pressure of the black ink.

The upper case 31 has, in the upper surface thereof four recesses defining respective third chambers 55*a*, 55*b*, 55*c*, 55*d* of the four buffer chambers 27*a*, 27*b*, 27*c*, 27*d*, at respective positions that are vertically aligned with respective portions of the four second chambers 39*a*, 39*b*, 39*c*, 39*d* that communicate with the respective ink flow outlets 41*a*, 41*b*, 41*c*, 41*d*, such that the four third chambers 55*a*, 55*b*, 55*c*, 55*d* are independent of each other. The four third chambers 55*a*, 55*b*, 55*c*, 55*d* communicate with the corresponding second chambers 39*a*, 39*b*, 39*c*, 39*d* via respective air holes 54 formed through the thickness of the upper case 31. Thus, each of the four buffer chambers 27 corresponding to the four color inks, respectively, includes three chambers, i.e., the first chamber 27-1, the second chamber 39, and the third chamber 55.

Since the black ink (BK) buffer chamber 27*a* corresponds to the greater number of nozzles 22*a* than the number of nozzles 22*b*, 22*c*, 22*d* corresponding to each of the other, three color inks, the black ink buffer chamber 27*a* has a greater volume than that of each of the other, three buffer chambers 27*b*, 27*c*, 27*d*, and the ink flow outlet 41*a* corresponding to the black ink has a greater cross-section area than that of each of the other, three ink flow outlets 41*b*, 41*c*, 41*d*. In addition, the ink supply tube 14*a* corresponding to the black ink has a greater cross-section area than that of each of the other, three ink supply tubes 14*b*, 14*c*, 14*d*. More specifically described, a ratio (e.g., about 2) of the cross-section area of the black ink supply tube 14*a* to the respective cross-section areas of the other ink supply tubes 14*b*, 14*c*, 14*d* is substantially equal to a ratio (e.g., 2) of the number of the black ink ejection nozzles 22*a* to the respective numbers of the other ink ejection nozzles 22*b*, 22*c*, 22*d*. Similarly, the ink flow inlet 47*a* and the connection passage 48 corresponding to the black ink have respective greater cross-section areas than that of each of the other, three ink flow inlets 47*b*, 47*c*, 47*d* and that of each of the other, three connection passages 48. That is, the ink-tank-side fluid flow channel including the black ink supply tube 14*a*, and the black ink buffer chamber 27*a* have a smaller resistance to flow of liquid therethrough than those of the other three ink-tank-side fluid flow channels and the other three ink buffer chambers 27*b*, 27*c*, 27*d*.

Figure 7A:
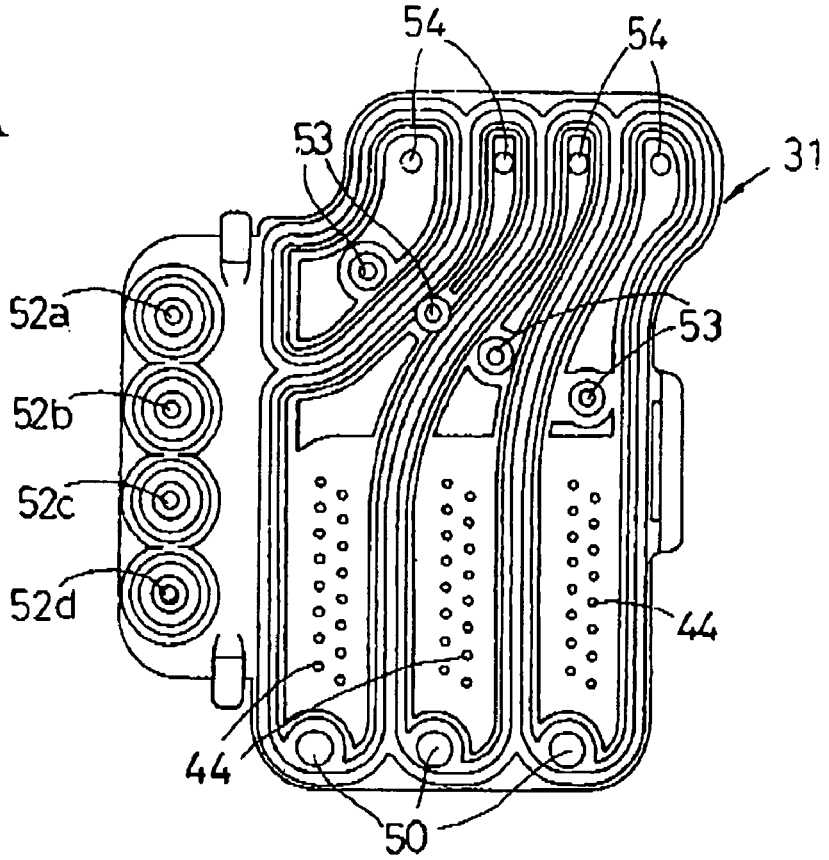
FIG. 7A is a bottom view of an upper case of the buffer case.
Figure 7B:
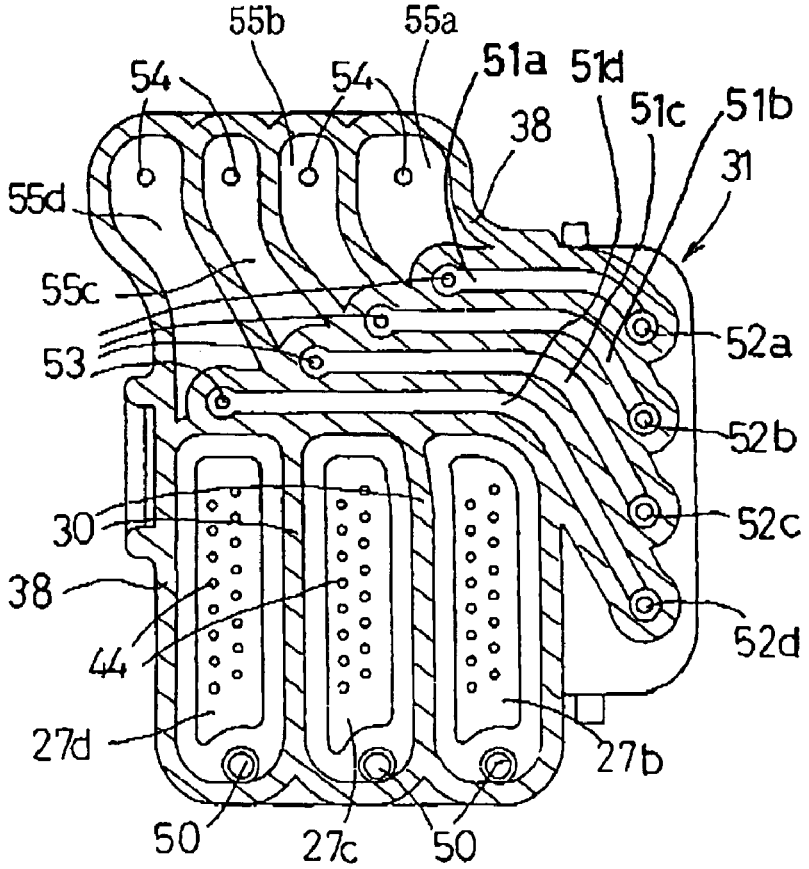
FIG. 7B is a plan view of the upper case of the buffer case.

The upper case 31 has, in the upper surface thereof, four fluid discharging passages 51 (51*a*, 51*b*, 51*c*, 51*d*) in the form of horizontal grooves and independent of each other, such that the fluid discharging passages 51 extend generally in a direction perpendicular to a lengthwise direction of the buffer case 25 in which the four ink flow inlets 47 and the four ink flow outlets 41 are opposite to each other. Moreover, the upper case 31 has four discharging holes 53 which are located between the three first chambers 27*b*-1, 27*c*-1, 27*d*-1 and the four third chambers 55*a*, 55*b*, 55*c*, 55*d* on a horizontal plane and which are formed through the thickness of the upper case 31 such that the four discharging holes 53 communicate with the four second chambers 39*a*, 39*b*, 39*c*, 39*d*, respectively. The four discharging holes 53 define respective upstream-side ends of the four fluid discharging passages 51. Respective downstream-side ends of the four fluid discharging passages 51 are connected to four connection ports 52*a*, 52*b*, 52*c*, 52*d* which correspond to the four color inks, respectively, and which communicate with four valve holes 56 of the opening and closing valve device 26 (described later), respectively, as shown in FIGS. 4 and 7B.

The four discharging holes 53 are formed in respective tubular walls that project downward from the upper case 31 into the respective second chambers 39*a*, 39*b*, 39*c*, 39*d*, and those discharging holes 53 open in the respective second chambers 39 at respective height positions distant from the lower surface of the upper case 31 by a predetermined distance. Thus, even after the air bubbles have been fully discharged from the second chambers 39 via the discharging holes 53, respective amounts of air each corresponding to the predetermined distance, i.e., the length of projection of the tubular walls in the downward direction from the upper case 31 are left in respective upper portions of the second chambers 39.

Respective upper openings of the respective third chambers 55*a*, 55*b*, 55*c*, 55*d* of the four buffer chambers 27*a*, 27*b*, 27*c*, 27*d*, and respective upper openings of the four fluid discharging passages 51 are closed by an extension portion of the upper flexible membrane 43. Thus, the four third chambers 55 and the four fluid discharging passages 51 are defined.

The buffer device 13 is fixed to the carriage 9, such that the primary partition wall 35 and the two flexible membranes 36, 43 extend parallel to the directions in which the carriage 9 is reciprocated, and parallel to the nozzle supporting surface 21*a* of the recording head 21 that supports the nozzles 22.

A discharging-device-side fluid flow channel from the discharging hole 53 communicating with the black ink (BK) buffer chamber 27*a* (i.e., the second chamber 39*a* thereof), to a lower open end of a corresponding one of the four valve holes 56 of the opening and closing valve device 26 via the fluid discharging passage 51*a* and the connection port 52*a*, has a smaller resistance to flow of liquid therethrough than that of each of other, three discharging-device-side fluid flow channels corresponding to the other three color inks (C, Y, M). More specifically described, the fluid discharging passage 51*a* corresponding to the black ink is shorter than each of the other, three fluid discharging passages 51*b*, 51*c*, 51*d*, and has a greater cross-section area than that of each of the other three fluid discharging passages 51*b*, 51*c*, 51*d*. However, it is possible that the fluid discharging passage 51*a* either be shorter than each of the other three fluid discharging passages 51*b*, 51*c*, 51*d*, or have a greater cross-section area than that of each of the same 51*b*, 51*c*, 51*d*. In addition, the liquid flow resistance of the discharging-device-side fluid flow channel corresponding to the black ink may be designed by changing at least one of the respective cross-section areas of the corresponding discharging hole 53, the connection port 52*a*, and the corresponding valve hole 56 of the opening and closing valve device 26. The four fluid discharging passages 51 define respective portions of the four discharging-device-side fluid flow channels that additionally include the four discharging holes 53 and the four valve holes 56, respectively.

The other three fluid discharging passages 51*b*, 51*c*, 51*d* corresponding to the other three color inks (C, Y, M) than the black ink (BK) have a same resistance to flow of liquid therethrough. Though the three fluid discharging passages 51*b*, 51*c*, 51*d* have respective different lengths, as shown in FIG. 7B, those passages 51*b*, 51*c*, 51*d* have respective different cross-section areas, so as to have the same liquid flow resistance.

Since the liquid flow resistance of the ink-tank-side fluid flow channel corresponding to the black ink (BK) is smaller than that of each of the other ink-tank-side fluid flow channels corresponding to the other, three color inks (C, Y, M), the liquid flow resistance of the discharging-device-side fluid flow channel corresponding to the black ink is designed to be also smaller than that of each of the discharging-device-side fluid flow channels corresponding to the other, three color inks. Owing to this structural feature, when the suction pump 74 is operated to apply simultaneously a common negative pressure to the maintenance liquid charged in the four ink supply tubes 14 and the four buffer chambers 27, via the four fluid discharging passages 51 and the four valve holes 56, the maintenance liquid is forced to flow out of the four valve holes 56, at a same flow velocity.

Next, the opening and closing valve device 26 will be described by reference to FIGS. 4 and 8A. The lower case 32 includes an accommodating portion 34 as one side portion thereof, i.e., a right-hand side portion thereof shown in FIGS. 4 and 8A. The accommodating portion 34 has the four valve holes 56 which correspond to the four color inks, respectively, and which are vertically elongate and open at respective upper and lower ends thereof. Each of the four valve holes 56 includes an upper large-diameter portion 56*a* and a lower small-diameter portion 56*b*, and accommodates a valve member 57 having a large diameter. A small-diameter valve rod 58 integrally extends downward from a central portion of a lower end surface of the valve member 57, and a packing member 59 such as an O-ring is fixed to an outer annular portion of the lower end surface of the valve member 57 so as to surround the valve rod 58. The large-diameter valve member 57 and the packing member 59 are located in the large-diameter portion 56*a*, such that the two members 57, 59 are movable upward and downward in the portion 56*a*, and the small-diameter valve rod 58 is located in the small-diameter portion 56*b*, such that a lower end of the valve rod 57 extends downward to a position around a lower open end of the portion 56*b*. In addition, the large-diameter portion 56*a* of each valve hole 56 accommodates a spring member 60, such as a coil spring, that biases the valve member 57 in a downward direction, so that the packing member 59 is pressed against a bottom wall of the large-diameter portion 56*a* and the valve member 57 is thus placed in its closed state.

One side portion of the upper case 31 horizontally extends to a location where the one side portion covers an upper end of the accommodating portion 34, as shown in FIG. 8A. As shown in FIG. 4, the respective downstream-side ends of the four fluid discharging passages 51 (51*a*, 51*b*, 51*c*, 51*d*) communicate with the respective connection ports 52 (52*a*, 52*b*, 52*c*, 52*d*) as the respective upper open ends of the four valve holes 56.

The maintenance unit 4 includes the large cap member 71 which can cover the entire nozzle supporting surface 21*a* of the recording head 21 that supports the five arrays of nozzles 22; and four small cap members 72 which can cover the respective lower open ends of the four small-diameter portions 56*b* of the opening and closing valve device 26, independent of each other, as shown in FIG. 8A. The maintenance unit 4 additionally includes an elevating and lowering device 73 as employed in a known maintenance unit. When the carriage 9 is moved to the head waiting position, i.e., the right-hand end position shown in FIG. 1, the elevating and lowering device 73 elevates the large and small cap members 71, 72 so as to contact closely the nozzle supporting surface 21*a* where the nozzles 22 open, and the lower end surface of the valve device 26 where the valve holes 56 open; and, when the carriage 9 is moved to other positions, the elevating and lowering device 73 lowers the cap members 71, 72 away from those surfaces. The large cap member 71 is connected to the suction pump 74, like in the known maintenance unit. When the suction pump 74 is driven or operated, the large cap member 71 sucks, and thereby removes, thickened inks and foreign matters from the nozzles 22.

The four small cap members 72 have respective projecting portions 72*a* that project from respective base portions thereof. When the small cap members 72 closely contact the lower surface of the opening and closing valve device 26, the projecting portions 72 push the corresponding valve members 57 upward against the respective biasing forces of the spring members 60, so that the respective packing members 59 are moved away from the respective bottom surfaces of the large-diameter portions 56*a* and thus the valve members 57 are placed in respective open states thereof. The four small cap members 72 are connected via a common flow passage to the suction pump 74. Therefore, when the suction pump 74 is driven, the air bubbles collected in the respective second chambers 39*a*, 39*b*, 39*c*, 39*d* of the four buffer chambers 27 are simultaneously sucked and discharged. More specifically described, when the color inks supplied from the ink tanks 5 via the flexible ink supply tubes 14 are temporarily stored in the second chambers 39, air bubbles naturally separate from the inks, and float on respective upper surfaces of the inks, so that those air bubbles are collected in the respective upper portions of the second chambers 39. The suction pump 74 sucks and discharges those air bubbles.

The switch or control valve 75 selectively connects the large cap member 71 or the small cap members 72 to the suction pump 74. Although the elevating and lowering device 73 concurrently elevates the large cap member 71 and the small cap members 72 to contact closely the nozzle supporting surface 21*a* of the recording head 21 and the lower surface of the opening and closing valve device 26, it is preferred that first the air bubbles accumulated in the respective upper portions of the four second chambers 39 be discharged via the respective small cap members 72 and subsequently the thickened inks be removed from the nozzles 22 via the large cap member 71. In a conventional manner in which the air bubbles collected in the second chambers 39 are discharged through the large cap member 71 only, too large amounts of inks are uselessly discharged. In contrast, in the present embodiment, the air bubbles can be discharged and accordingly the recording head 21 can be recovered while only small amounts of inks are discharged. The maintenance unit 4 is controlled by a control device 201 (FIG. 21), described later.

It is possible to perform the operation of sucking the thickened inks from the nozzles 22, and the operation of discharging the air bubbles from the buffer chambers 27 (i.e., the second chambers 39 thereof), independent of each other.

In a modified mode of the present embodiment, the suction pump 74 may be replaced with a positive pressure applying pump. In this modified mode, when the positive pressure applying pump applies a positive pressure (i.e., a pressurized air) to the inks stored in the ink tanks 5, thickened inks and foreign matters can be removed from the nozzles 22, and air bubbles can be discharged from the second chambers 39. In another modified form of the present embodiment, it is possible to employ both the suction pump 74 and the positive pressure applying pump.

Figure 9:
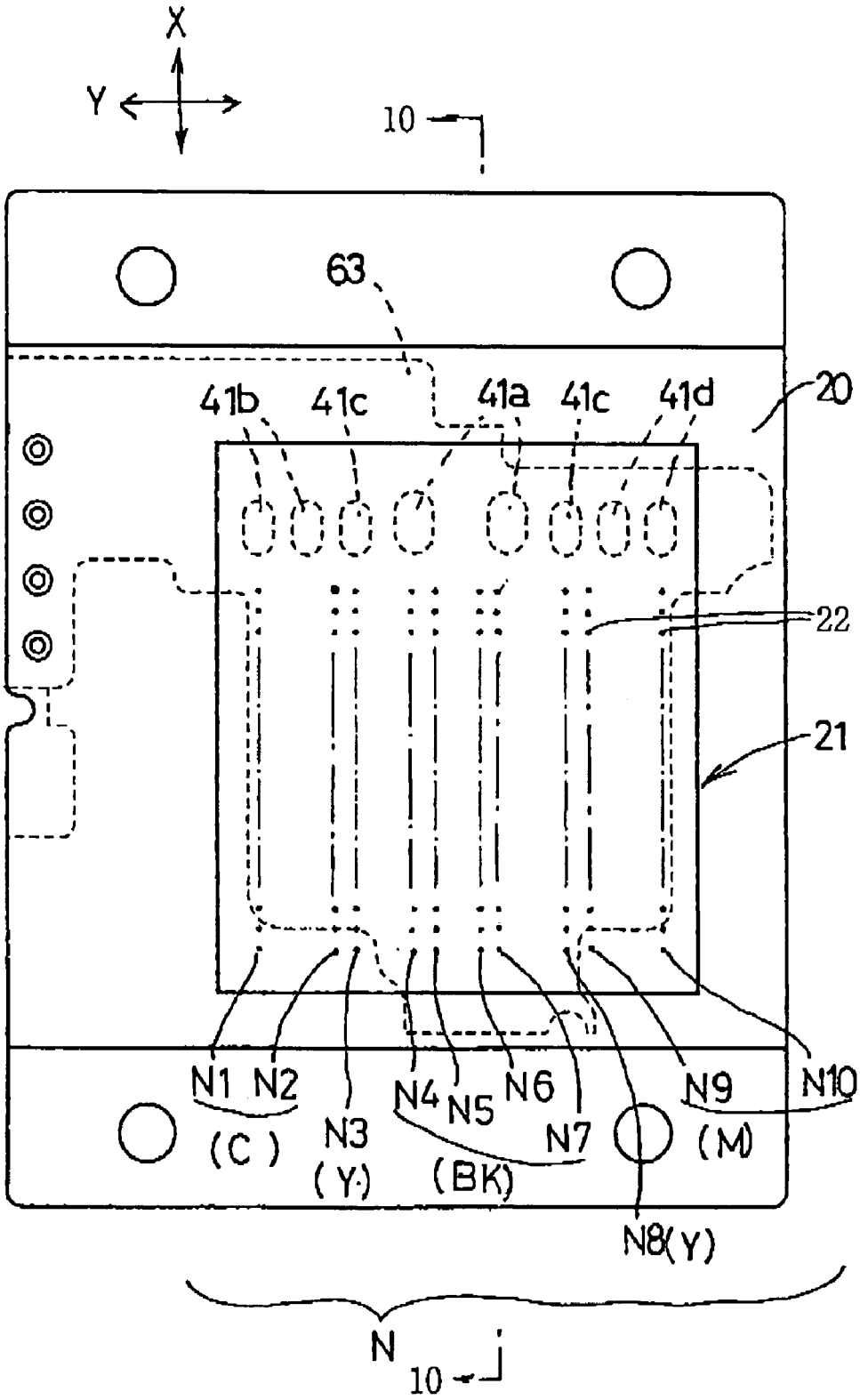
FIG. 9 is a bottom view of a recording head and a head holder of another ink jet printer as a second embodiment of the present invention.

Next, a second embodiment of the present invention will be described by reference to FIGS. 9 through 19B. In the second embodiment, four color inks, i.e., black, cyan, yellow, and magenta inks (BK, C, Y, M) are supplied to a recording head 21 which has, as shown in FIG. 9, four arrays of nozzles 22 corresponding to the black ink, two arrays of nozzles 22 corresponding to the cyan ink, two arrays of nozzles 22 corresponding to the yellow ink, and two arrays of nozzles 22 corresponding to the magenta ink. Thus, the recording head 21 shown in FIG. 9 has ten arrays of nozzles 22 in total that are arranged in a Y direction in which a head holder 20 holding the recording head 21 is moved with a carriage 9, shown in FIG. 1. The recording head 21 shown in FIG. 9 may be employed, in place of the recording head 21 shown in FIG. 2, by the ink jet printer shown in FIG. 1.

Figure 10:
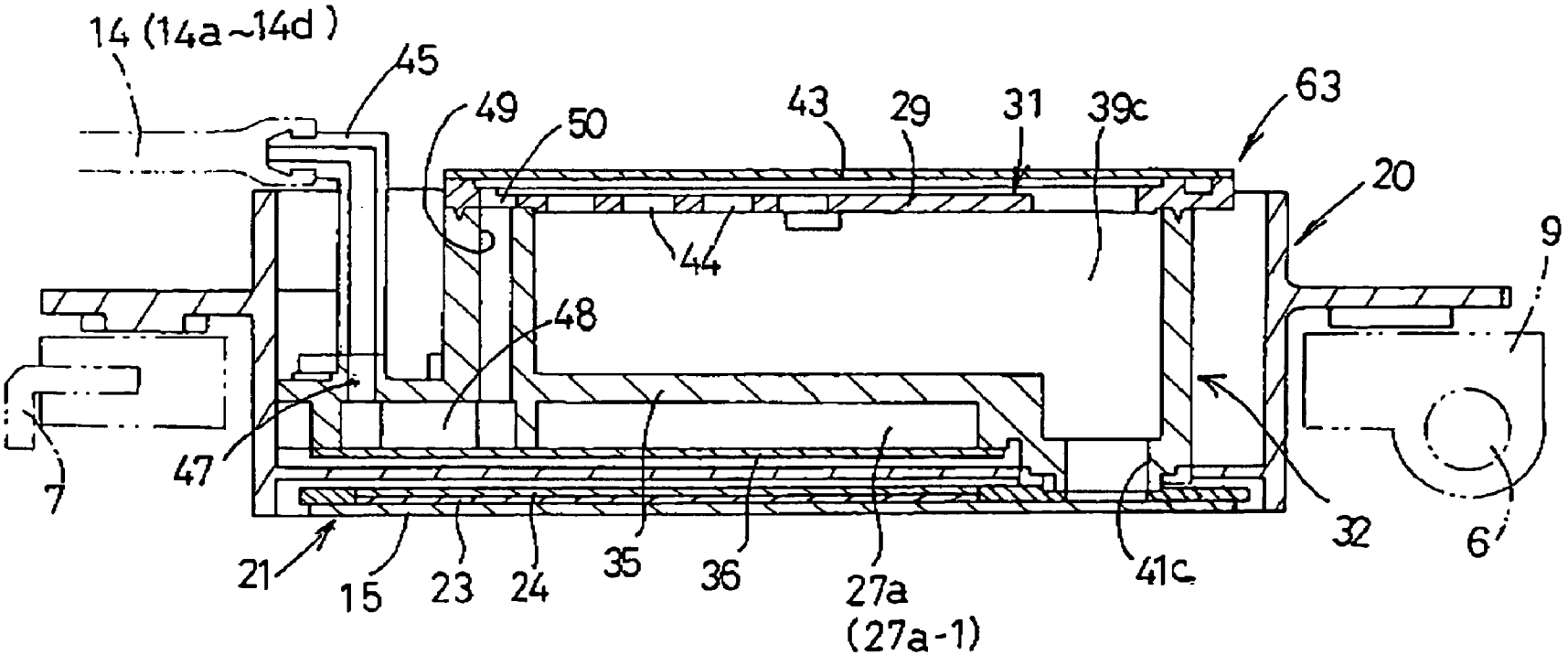
FIG. 10 is a cross-section view taken and viewed along arrows indicated by 10, 10 in FIG. 9.

First, a construction of the recording head 21 will be described by reference to FIGS. 9, 10, and 11. The recording head 21 includes four recording head portions that correspond to the four color inks, respectively, and that are arranged parallel to each other and are integrally connected to each other. More specifically described, the recording head 21 includes a cavity unit 15, a sheet-type piezoelectric actuator unit 23, and a flexible flat cable 24. The cavity unit 15 is constituted by a plurality of metallic sheets that are stacked on each other. The actuator unit 23 is stacked on the cavity unit 15 via adhesive, or an adhesive sheet. The flat cable 24 is stacked on, and bonded to, a back surface (i.e., an upper surface) of the actuator unit 23 so as to connect electrically the actuator unit 23 to an external device, not shown.

Figure 11:
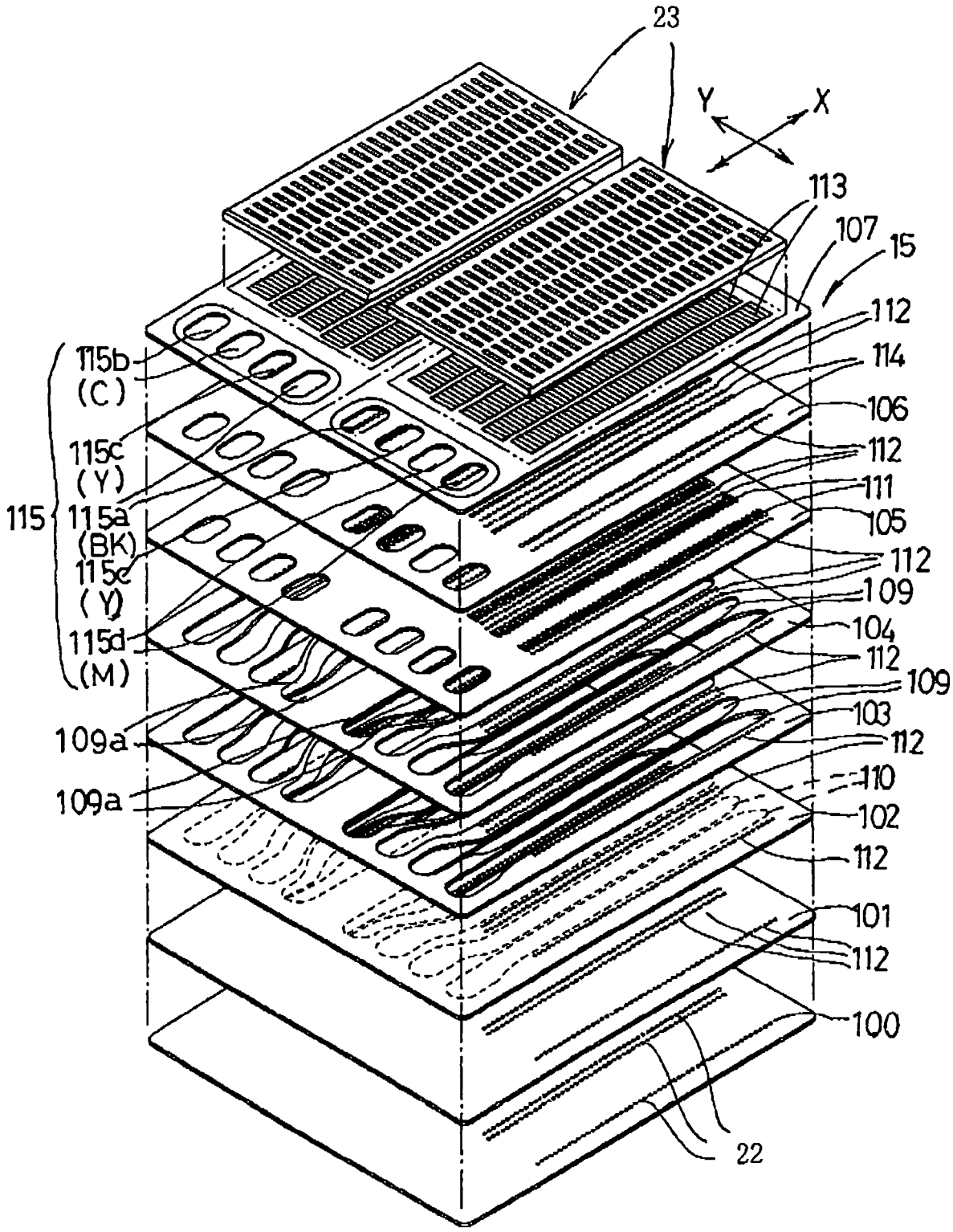
FIG. 11 is an exploded, perspective view of the recording head of FIG. 9.

As shown in FIG. 11, the cavity unit 15 includes eight thin metallic sheets in total, that is, it includes, in an order from the bottom to the top, a nozzle sheet 100, a first spacer sheet 101, a damper sheet 102, two manifold sheets 103, 104, a second spacer sheet 105, a third spacer sheet 106, and a base sheet 107. The eight metallic sheets are stacked on, and bonded with adhesive to, each other. Each of the metallic sheets is formed of a 42% nickel alloy steel, and has a thickness of from about 50 μm to about 150 μm.

FIG. 9 is a bottom view of the recording head 21. The recording head 21 has ten nozzle arrays N1 through N10 which are arranged at an appropriate interval of distance in the Y direction and each of which extends in an X direction perpendicular to the Y direction.

The ten nozzle arrays N1 through N10 are arranged in an order from the left-hand side to the right-hand side in FIG. 9. The nozzle arrays N1, N2 correspond to the cyan ink (C); the nozzle arrays N3, N8 correspond to the yellow ink (Y); the nozzle arrays N4, N5, N6, N7 correspond to the black ink (BK); and the nozzle arrays N9, N10 correspond to the magenta ink (M). Thus, the total number of the nozzles 22 corresponding to the black ink is twice the total number of the nozzles 22 corresponding to each of the other three color inks.

Each of the upper and lower manifold sheets 103, 104 has ten ink passages that correspond to the ten nozzle arrays N1 through N10, respectively, are elongate in the X direction, and are formed through a thickness thereof. In a state in which the two manifold sheets 103, 104 are sandwiched by the second spacer sheet 105 located on the sheets 103, 104 and the damper sheet 102 located under the same 103, 104, the above-indicated ten ink passages define ten common ink chambers (i.e., ten ink manifolds) 109. In FIG. 9, a pair of fourth and fifth common ink chambers 109, as counted from the left-hand side, and a pair of sixth and seventh common ink chambers 109 correspond to the black ink, and respective one ends 109*a* of each of the two pairs of common ink chambers 109 are located adjacent each other so that the two ends 109*a* can receive the black ink from a corresponding one of two ink supply inlets 115*a* corresponding to the black ink.

The damper sheet 102 adhered to a lower surface of the lower manifold sheet 103 has, in a lower surface thereof ten damper chambers 110 that correspond to the ten common ink chambers 109, respectively, and are elongate in the X direction. The damper chambers 110 are given in the form of grooves that open in only the lower surface of the damper sheet 102. In a state in which the lower surface of the damper sheet 102 is covered by the first spacer sheet 101 located under the same 102, the cavity unit 15 has the ten damper chambers 110.

The base sheet 107 has ten arrays of pressure chambers 113 corresponding to the ten nozzle arrays N1–N10, respectively, and the pressure chambers 113 communicate, at respective one ends thereof, with the nozzles 22, respectively. Each of the pressure chambers 113 extends in the Y direction, and has a small width. The pressure chambers 113 of each of the ten arrays N1–N10 communicate, at the respective other ends thereof, with a corresponding one of the ten common ink chambers 109 via respective communication holes 114 formed in the third spacer sheet 106 and respective restricting portions in the form of respective narrow grooves 111 formed in the second spacer sheet 105. The above-indicated respective one ends of the pressure chambers 113 communicate with the corresponding nozzles 22 via respective through-holes 112 formed in the first spacer sheet 101, the damper sheet 102, the two manifold sheets 103, 104, and the second and third spacer sheets 105, 106.

As shown in FIG. 11, the base sheet 107, the third spacer sheet 106, and the second spacer sheet 105 have, in respective one end portions thereof, eight ink supply inlets 115 (115*a*, 115*b*, 115*c*, 115*d*), two for each color ink. That is, two ink supply inlets 115*a* correspond to the black ink (BK); two ink supply inlets 115*b* correspond to the cyan ink (C); two ink supply inlets 115*c* correspond to the yellow ink (Y); and two ink supply inlets 115*d* correspond to the magenta ink (M).

Thus, the four color inks supplied from the eight ink supply inlets 115 to the ten common ink chambers 109 are distributed to the pressure chambers 113 via the restricting portions 111 and the communication holes 114, and then are supplied from the pressure chambers 113 to the corresponding nozzles 22 via the through-holes 112.

Figure 12:
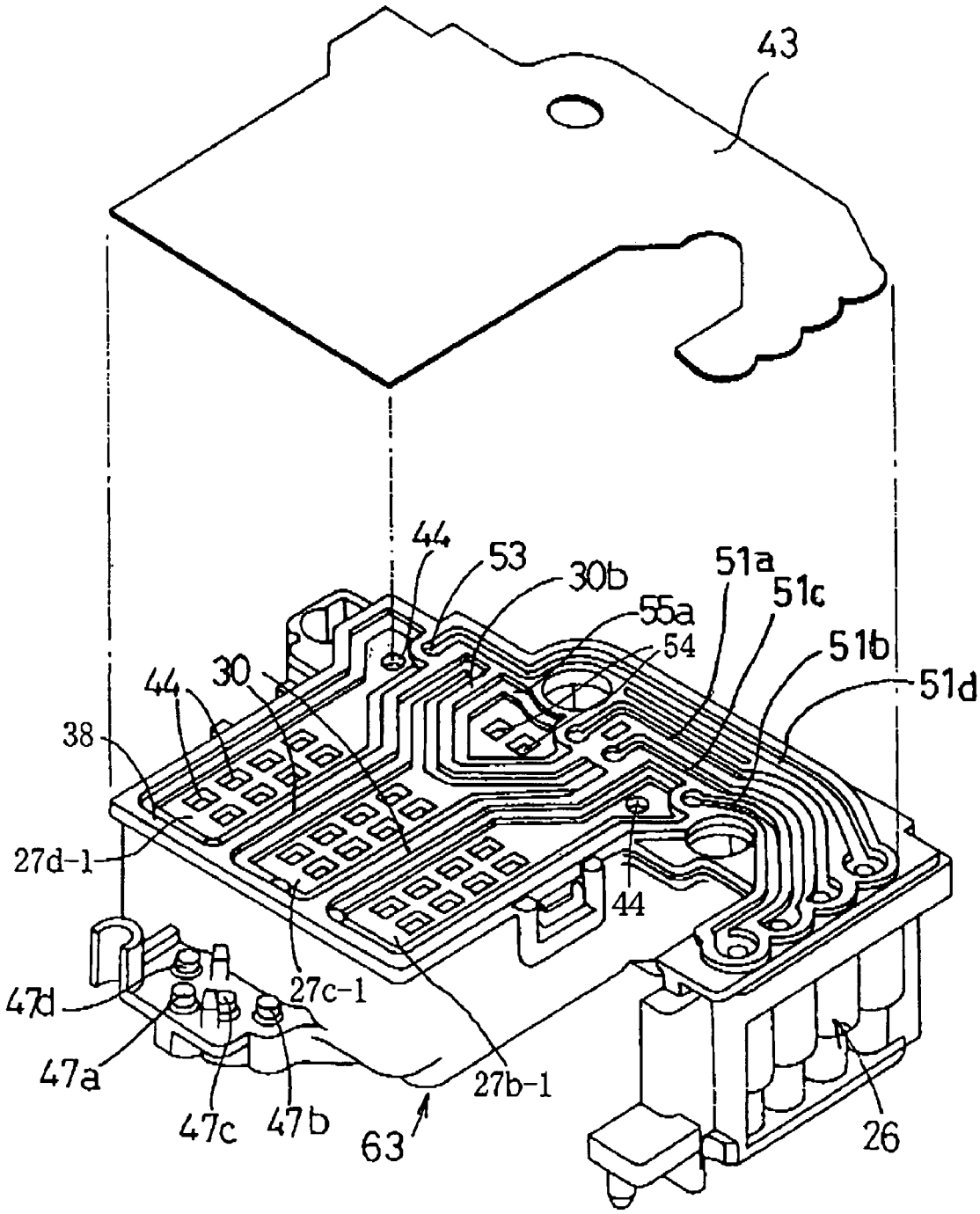
FIG. 12 is a perspective top view of a buffer device of the ink jet printer of FIG. 9.

In the second embodiment, a buffer device 63 supplies the four color inks to the recording head 21, as shown in FIGS. 9 and 11. More specifically described, although four ink flow inlets 47 (47*a*, 47*b*, 47*c*, 47*d*) are provided for the four color inks, respectively, that is, one ink inflow inlet 47 is provided for each color ink, as shown in FIG. 12, two ink flow outlets 41 (41*a*, 41*b*, 41*c*, 41*d*) are provided for each color ink, as shown in FIG. 9. Since the second embodiment is a modified form of the first embodiment, the same reference numerals as used in the first embodiment are used to designate the corresponding elements and parts of the second embodiment, and the description thereof is omitted, as needed.

In the second embodiment, the buffer device 63 includes a buffer case (i.e., a case unit) 25 including an upper case 31 and a lower case 32. The upper case 31 is liquid-tightly bonded by, e.g., ultrasonic welding to an upper end of the lower case 32.

Figure 13:
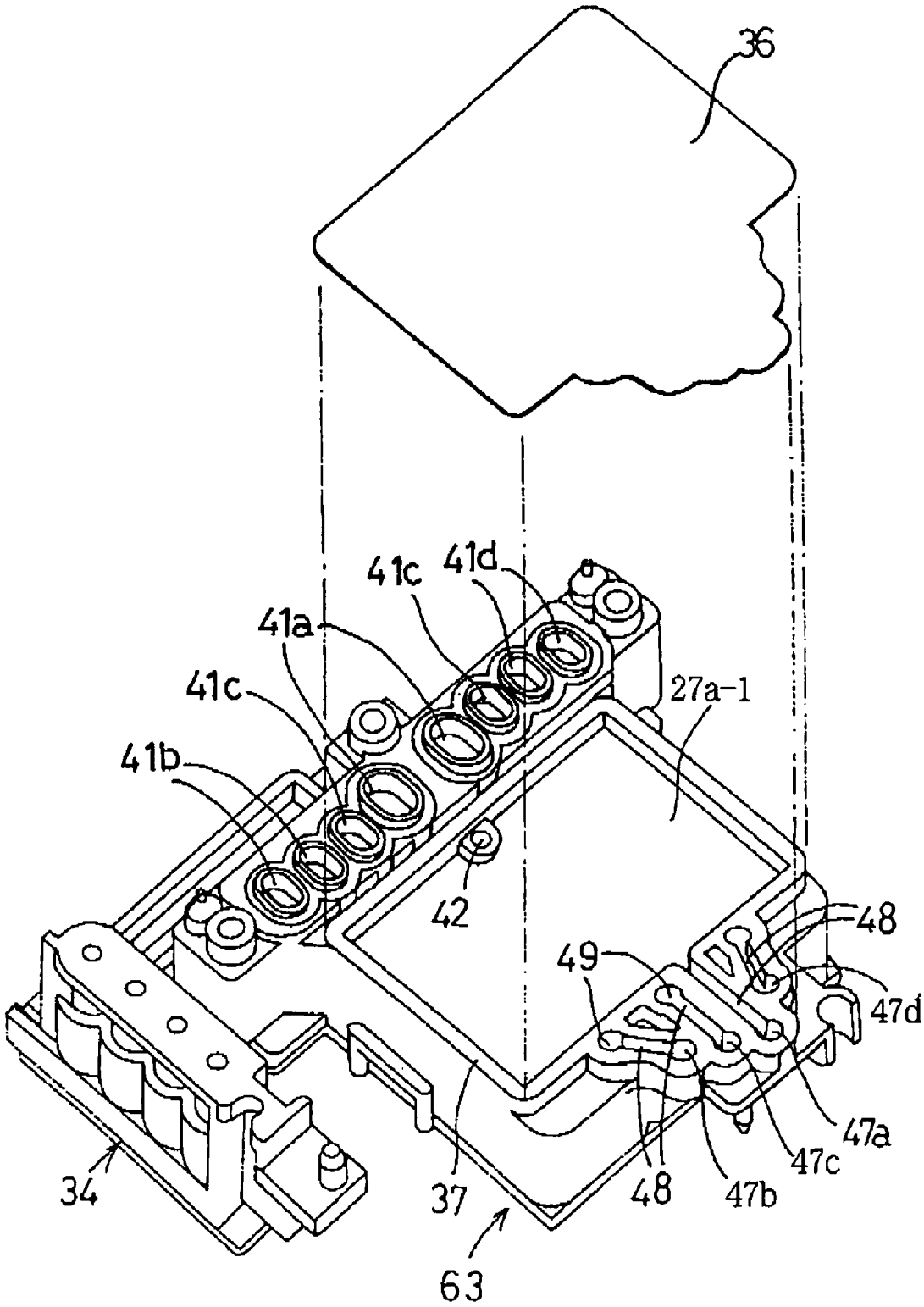
FIG. 13 is a perspective bottom view of the buffer device of FIG. 12.

The second embodiment resembles the first embodiment in that, as shown in FIG. 18B, the lower case 32 has, under a primary partition wall 35 thereof, a first chamber 27*a*-1 of a buffer chamber 27*a* corresponding to the black ink (BK). The first chamber 27*a*-1 occupies a major portion of a lower end of the lower case 32, and opens downward, and a lower flexible membrane 36 is bonded to the lower end of the lower case 32 so as to close the lower opening of the first chamber 27*a*-1. In addition, the lower case 32 has, in the vicinity of the lower opening of the first chamber 27*a*-1, the eight ink flow outlets 41*a*, 41*b*, 41*c*, 41*d*. In the second embodiment, as shown in FIG. 13, the two central ink flow outlets 41*a* correspond to the black ink (BK); the two ink flow outlets 41*c* located on either side of the central two ink flow outlets 41*a* correspond to the yellow ink (Y); the left-hand two ink flow outlets 41*b* correspond to the cyan ink (C); and the right-hand two ink flow outlets 41*d* correspond to the magenta ink (M).

Figure 14A:
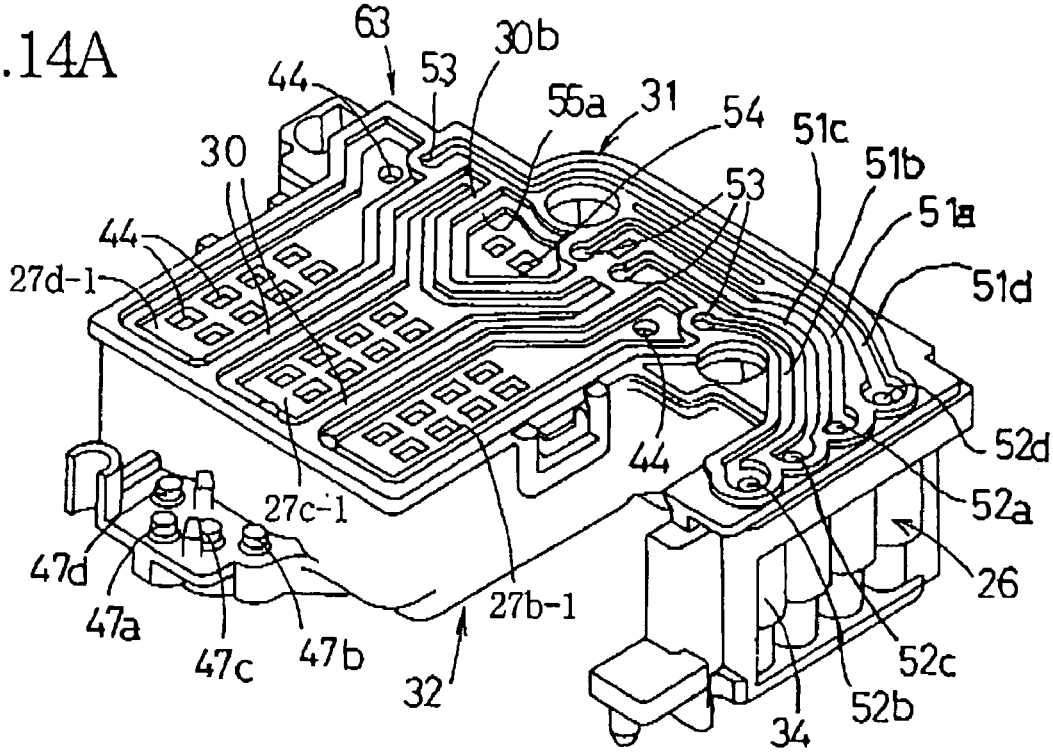
FIG. 14A is a perspective top view of a buffer case (i.e., a case unit) of the buffer device of FIG. 12.
Figure 14B:
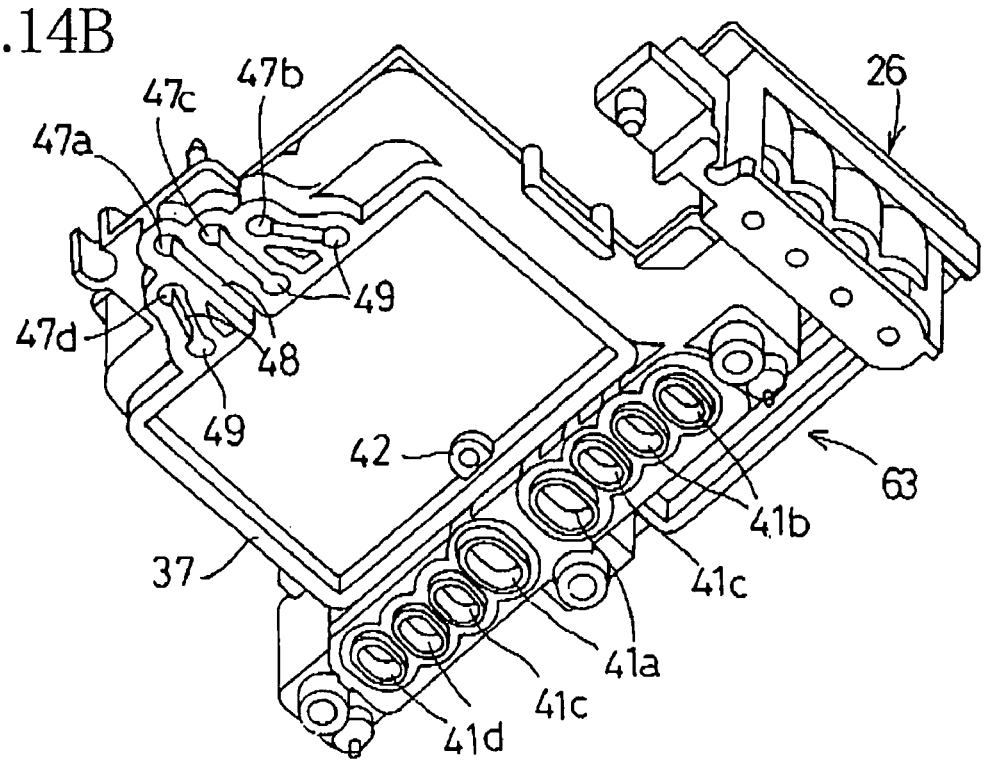
FIG. 14B is a perspective bottom view of the buffer case of FIG. 14A.
Figure 15A:
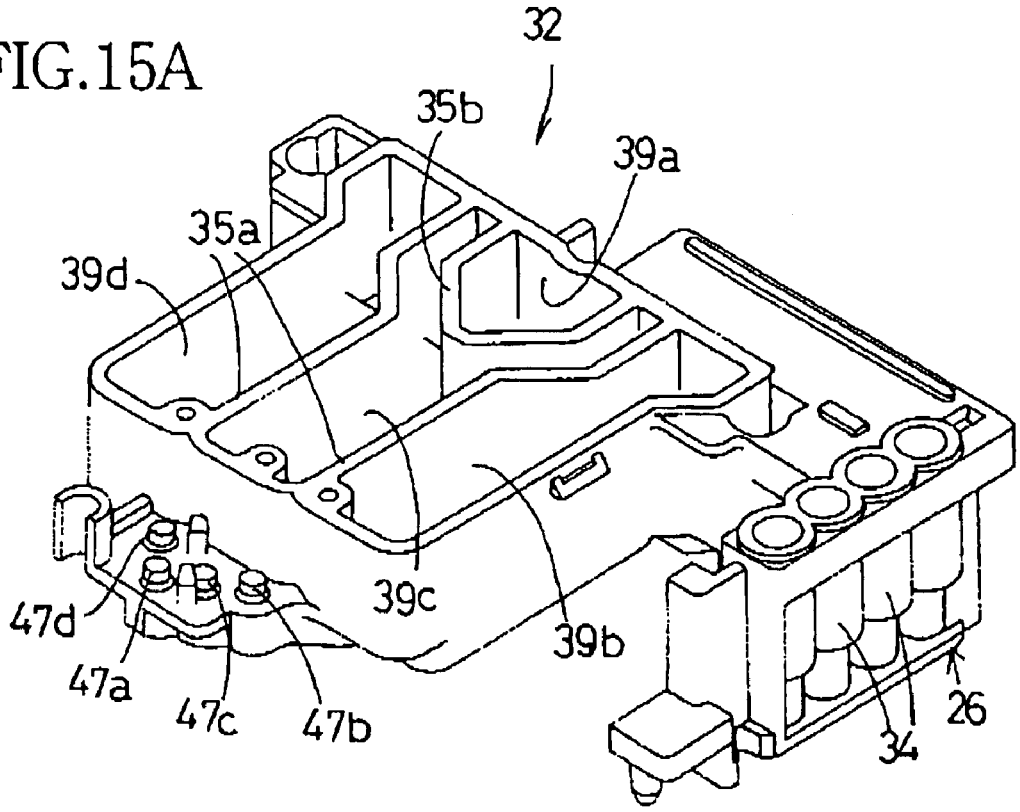
FIG. 15A is a perspective top view of a lower case of the buffer case of FIG. 14A.
Figure 15B:
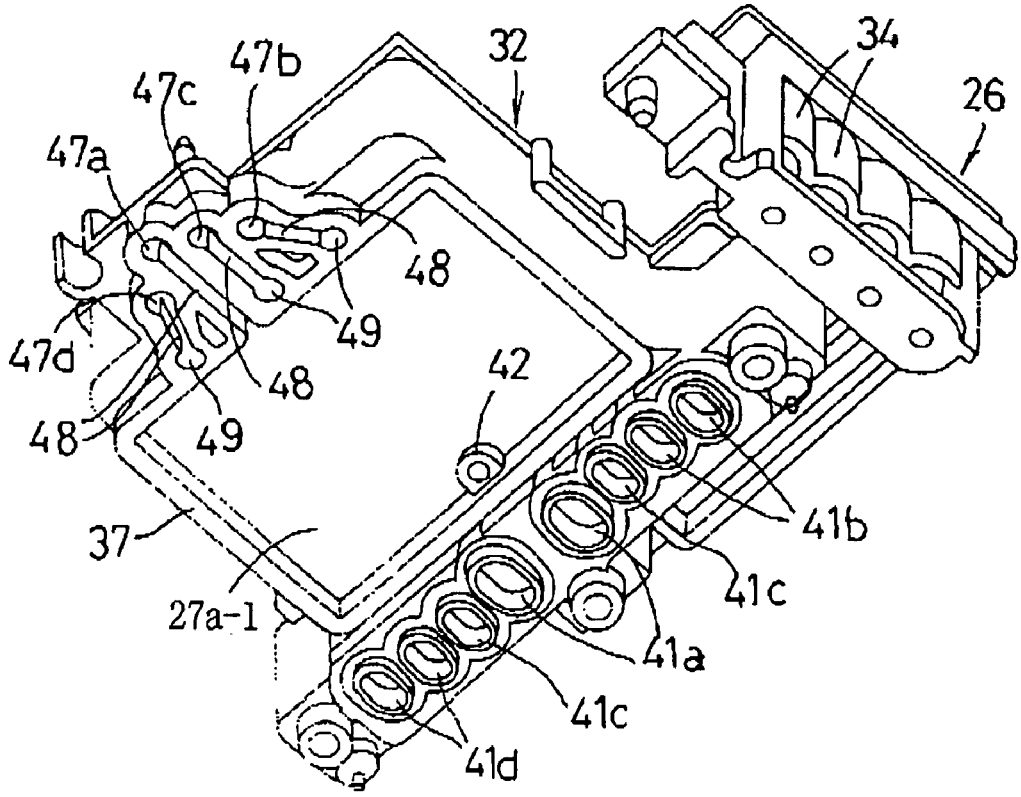
FIG. 15B is a perspective bottom view of the lower case of FIG. 15A.
Figure 17:
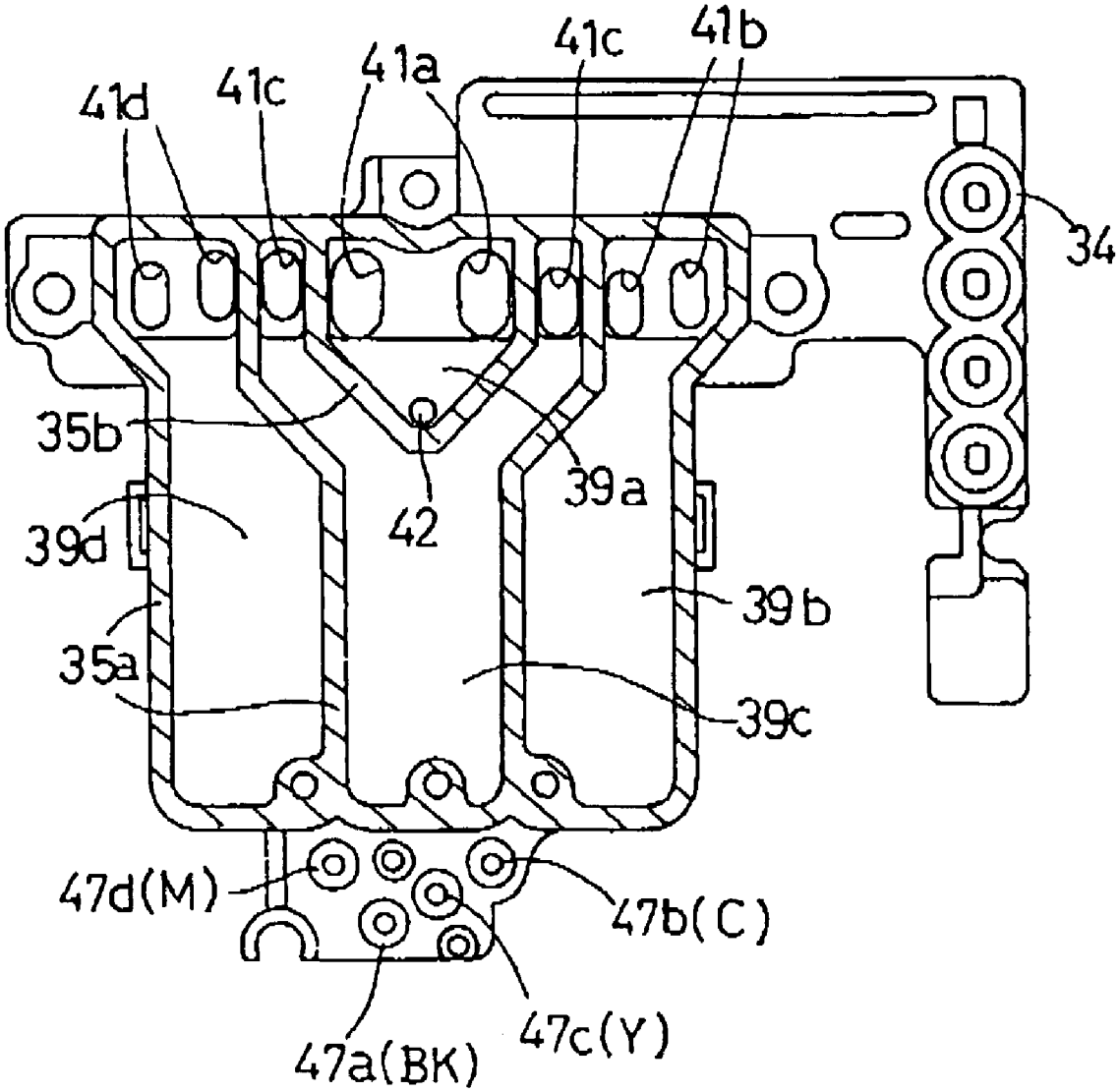
FIG. 17 is a plan view of the lower case of FIG. 15A.

As shown in FIGS. 15A, 15B, and 17, a second chamber 39*a* of the buffer chamber 27*a* corresponding to the black ink (BK) is defined, in its plan view, by a secondary partition wall 35*b* which is so formed as to surround the two central ink flow outlets 41*a*, and the second chamber 39*a* communicates with the first chamber 27*a*-1 via an ink flow passage 42 formed through the primary partition wall 35. The ink flow passage 42 functions as a flow restricting portion. In addition, as shown in FIG. 14A, the upper case 31 has, in an upper surface thereof, a third chamber 55*a* of the black-ink buffer chamber 27*a* that is defined by a secondary partition wall 30*b* which is aligned with the secondary partition wall 35*b* of the lower case 32. The third chamber 55*a* communicates with the second chamber 39*a* via air holes 54 formed through a thickness of the upper case 31.

Figure 16A:
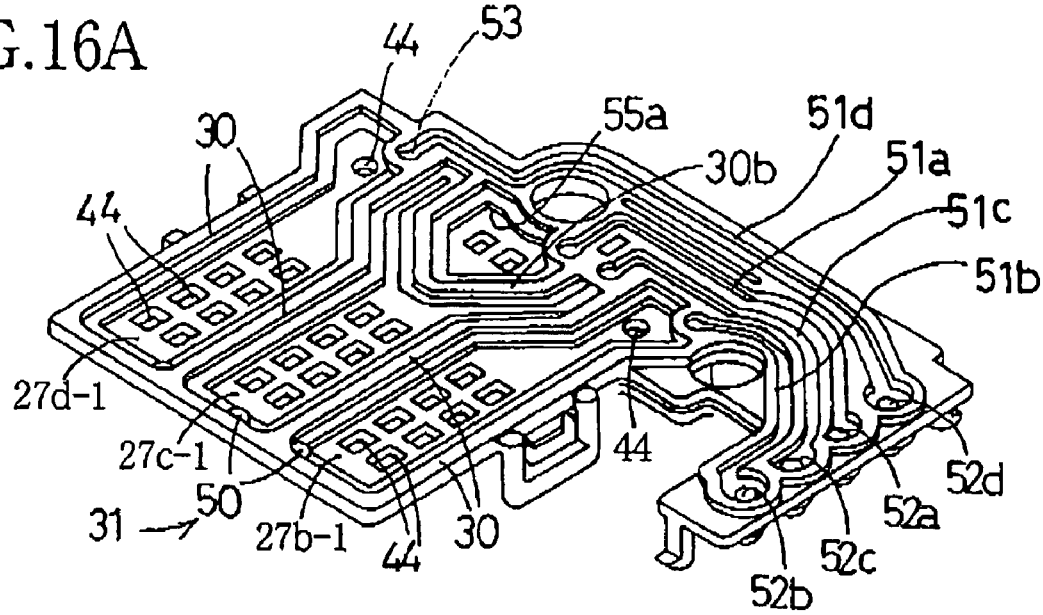
FIG. 16A is a perspective top view of an upper case of the buffer case of FIG. 14A.

The second embodiment also resembles the first embedment, in that three buffer chambers 27*b*, 27*c*, 27*d* corresponding to the cyan, yellow, and magenta inks (C, Y, M), respectively, are defined by two secondary partition walls 35*a* projecting upward from an upper surface of the primary partition wall 35, and two central secondary partition walls 30 which project upward from the upper surface of the upper case 31 and are aligned with the two secondary partition walls 35*a*, respectively, as shown in FIGS. 12, 14A, and 16A. More specifically described by reference to FIG. 18B, the buffer chambers 27*b*, 27*c*, 27*d* include respective first chambers 27*b*-1, 27*c*-1, 27*d*-1 located above a bottom wall (i.e., a lid portion) 29 of the first case 31, and respective second chambers 39*b*, 39*c*, 39*d* located below the bottom wall 29. As shown in FIGS. 15A and 17, the three second chambers 39*b*, 39*c*, 39*d* extend over a substantially entire length of the lower case 32, and communicate with the ink flow outlets 41*b*, 41*c*, 41*d*, respectively. In the second embodiment, the second chamber 39*c* corresponding to the yellow ink (Y) has, in its plan view, a generally Y-shaped configuration; and the second chambers 39*b*, 39*d* corresponding to the cyan and magenta inks (C, M) are located on either side of the Y-shaped second chamber 39*b*, respectively.

Figure 16B:
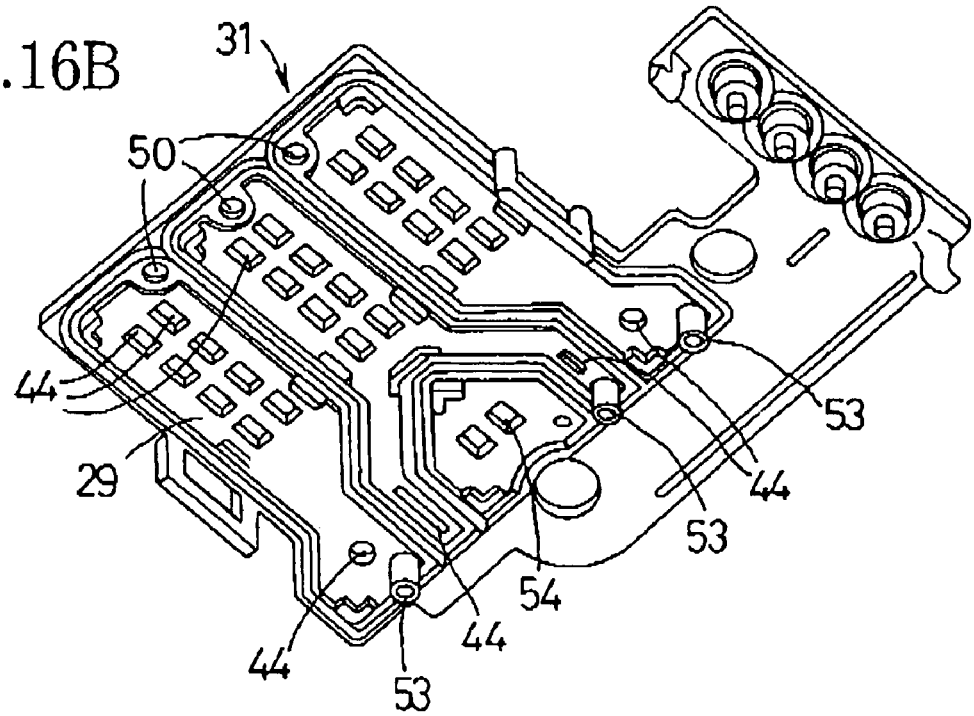
FIG. 16B is a perspective bottom view of the upper case of FIG. 16A.

The three first chambers 27*b*-1, 27*c*-1, 27*d*-1 provided on the upper side of the upper case 31 are located above the corresponding second chambers 39*b*, 39*c*, 39*d*. However, in the second embodiment, the buffer case 20 does not have respective third chambers corresponding to the cyan, yellow, and magenta inks (C, Y, M). As shown in FIGS. 16A and 16B, for each of the three first chambers 27*b*-1, 27*b*-*c*, 27*d*-1, the bottom wall 29 has a plurality of first communication holes 44 in the vicinity of a corresponding one of three communication passages 50, described later, and additionally has one or two second communication holes 44 in the vicinity of corresponding two ink flow outlets out of the six ink flow outlets 41*b*, 41*c*, 41*d*, so that the first and second communication holes 44 allow each of the first chambers 27*b*-1, 27*c*-1, 27*d*-1 to communicate with a corresponding one of the second chambers 39*b*, 39*c*, 39*d*.

As shown in FIGS. 12, 14A, and 16A, the upper case 31 additionally has the four fluid discharging passages 51 in the form of horizontal grooves formed in the upper surface of the case 31. The fluid discharging passages 51 communicate, at the respective discharging holes 53 as respective upstream-side ends of the passages 51, with the respective second chambers 39*a*, 39*b*, 39*c*, 39*d*, and communicate, at the respective connection ports 52 (52*a*, 52*b*, 52*c*, 52*d*) as respective downstream-side ends of the passages 51, with four valve holes 56 of an opening and closing valve device 26 whose construction is identical with that of the opening and closing valve device 26 employed in the first embodiment.

Moreover, the second embodiment resembles the first embodiment in that the three discharging holes 53 corresponding to the cyan, yellow, and magenta inks (C, Y, M) open downward at respective height positions lower than respective ceiling surfaces of the three second chambers 39*b*, 39*c*, 39*d*, as shown in FIG. 16B, so that respective spaces in which respective amounts of air are held, are defined in respective upper portions of the second chambers 39*b*, 39*c*, 39*d*, as shown in FIG. 18B.

Respective upper openings of the three first chambers 27*b*-1, 27*c*-1, 27*d*-1, the third chamber 55*a* corresponding to the black ink, and the four fluid discharging passages 51 are closed by a single upper flexible membrane 43, as shown in FIG. 12.

Figure 19A:
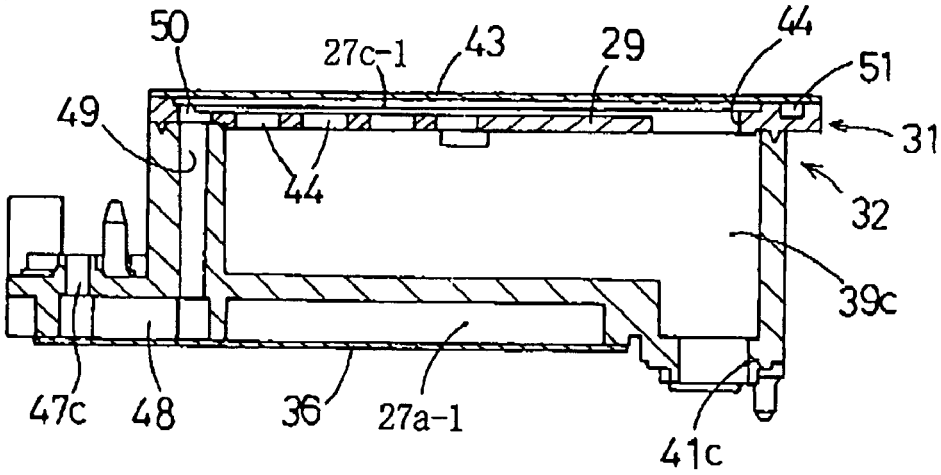
FIG. 19A is a cross-section view taken and viewed along arrows indicated by 19A, 19A in FIG. 18A.
Figure 19B:
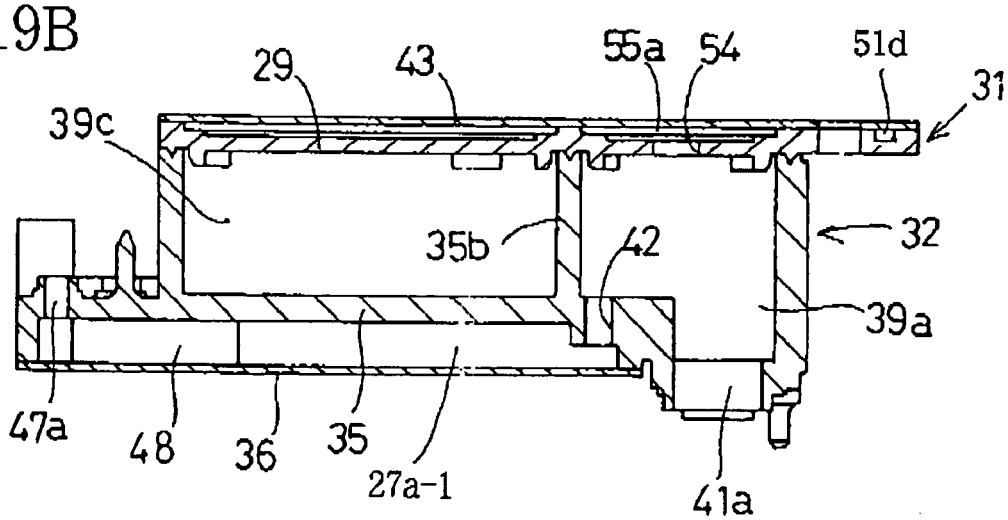
FIG. 19B is a cross-section view taken and viewed along arrows indicated by 19B, 19B in FIG. 18A.

The lower case 32 has the four ink flow inlets 47*a*, 47*b*, 47*c*, 47*d* which are similar to the four ink flow inlets 47*a*, 47*b*, 47*c*, 47*d* employed in the first embodiment. The ink flow inlet 47*a* corresponding to the black ink (BK) is connected to the black ink buffer chamber 27*a* (i.e., the first chamber 27*a*-1 thereof, via a connection passage 48 in the form of a horizontal groove; and the ink flow inlets 47*b*, 47*c*, 47*d* corresponding to the cyan, yellow, and magenta inks are connected to the cyan, yellow, and magenta ink buffer chambers 27*b*, 27*c*, 27*d* (i.e., the first chambers 27*b*-1, 27*c*-1, 27*d*-1 thereof, via respective connection passages 48 in the form of horizontal grooves, respective communication passages 49, and respective communication passages 50, as shown in FIGS. 10 and 19A. Respective lower openings of the ink flow inlets 47*a*, 47*b*, 47*c*, 47*d* and the connection passages 48 are closed by an extension portion of the lower flexible membrane 36.

The second embodiment additionally resembles the first embodiment in that respective cross-section areas of an ink supply tube 14*a*, the ink flow inlet 47*a*, the connection passage 48, and the buffer chamber 27*a* corresponding to the black ink (BK) are greater than those of ink supply tubes 14*b*, 14*c*, 14*d*, the ink flow inlets 47*b*, 47*c*, 47*d*, the connection passages 48, and the buffer chambers 27*b*, 27*c*, 27*d* corresponding to the other, three color inks; and an ink-tank-side fluid flow channel including the black ink supply tube 14*a*, and the black ink buffer chamber 27*a* have a smaller resistance to flow of liquid therethrough than those of the other, three ink-tank-side fluid flow channels and the other, three ink buffer chambers 27*b*, 27*c*, 27*d* corresponding to the other, three color inks. Similarly, a discharging-device-side fluid flow channel from the discharging hole 53 communicating with the black-ink buffer chamber 27*a*, to the lower open end of the corresponding valve hole 56 via the fluid discharging passage 51*a* and the connection port 52*a* has a smaller resistance to flow of liquid therethrough than those of the other, three discharging-device-side fluid flow channels corresponding to the other, three color inks. Thus, like in the first embodiment, when a suction pump 74, shown in FIG. 18B, is operated to apply simultaneously a common negative pressure to the maintenance liquid present in the four ink supply tubes 14 and the four buffer tanks 27, via the four valve holes 56 of the opening and closing valve device 26, the four color inks are forced to flow out of the respective lower open ends of the four valve holes 56, respectively, at a same velocity.

In each of the first and second embodiments, when the carriage 9 is reciprocated, during a recording operation, in the leftward and rightward directions in FIG. 1, the flexible ink supply tubes 14 (14*a*, 14*b*, 14*c*, 14*d*) are also moved in the leftward and rightward directions so as to follow the carriage 9. Because of an inertia force produced upon returning of the carriage 9, the pressure of the ink present in each of the ink supply tubes 14 largely changes. This pressure change propagates via a corresponding one of the ink flow inlets 47 (47*a*, 47*b*, 47*c*, 47*d*) to a corresponding one of the buffer chambers 27 (27*a*, 27*b*, 27*c*, 27*d*). Since the flexible membranes 36, 43 liquid-tightly closing the buffer chambers 27 are flexed or deformed, the change of pressure of the ink accommodated in each buffer chamber 27 can be damped.

The respective pressure changes propagating to the respective first chambers 27*a*-1, 27*b*-1, 27*c*-1, 27*d*-1 of the buffer chambers 27*a*, 27*b*, 27*c*, 27*d* are restricted by the communication passage 42 and the communication holes 44 each functioning as the flow restricting portion. Accordingly, the flexible membranes 36, 43 are largely flexed or deformed by those pressure changes. In addition, since the communication passages 49, 50 communicating with the first chambers 27*b*-1, 27*c*-1, 27*d*-1 corresponding to the cyan, yellow, and magenta inks open at respective positions opposed, and near, to the upper flexible membrane 43, the pressure changes are directly received, and quickly absorbed, by the same 43.

Moreover, usually, respective air layers are held in the respective upper portions of the second chambers 39*a*, 39*b*, 39*c*, 39*d* (in each of the first and second embodiments), and also in the third chambers 55*a*, 55*b*, 55*c*, 55*d* (in the first embodiment) or the third chamber 55*a* (in the second embodiment), and accordingly those air layers exhibit respective pressure-change buffering effects. Furthermore, the upper flexible membrane 43 liquid-tightly closing the first chambers 27*b*-1, 27*c*-1, 27*d*-1 and the third chambers 55*a*, 55*b*, 55*c*, 55*d* (in the first embodiment) or the third chamber 55*a* (in the second embodiment), is deformed to absorb and reduce the pressure changes produced in the buffer chambers 27*a*, 27*b*, 27*c*, 27*d* and the above-described pressure changes propagating thereto. Thus, the respective pressures of the inks present in the nozzles 22 of the recording head 21 can be kept uniform and accordingly the quality of recording of the recording head 21 can be improved.

The respective flows of the inks entering the first chambers 27*a*-1, 27*b*-1, 27*c*-1, 27*d*-1 of the buffer chambers 27*a*, 27*b*, 27*c*, 27*d* are decelerated by the respective flow restricting effects of the communication passage 42 and the communication holes 44 each functioning as the flow restricting portion, and then those inks enter the second chambers 39*a*, 39*b*, 39*c*, 39*d*. In the second chambers 39*a*, 39*b*, 39*c*, 39*d*, the air bubbles contained in the inks move up and separate from the inks. Then, the inks not containing the air bubbles are supplied to the recording head 21 via the ink flow outlets 41*a*, 41*b*, 41*c*, 41*d*.

In each of the above-described two embodiments, the nozzle supporting surface of the recording head unit 3 is substantially horizontal, and the recording head 21 ejects, from the nozzles 22, the inks in a downward direction. Thus, the buffer device 13 is located above the recording head 21, such that the primary partition wall 35 and the flexible membranes 36, 43 are substantially horizontal, and such that between the lower flexible membrane 36 and the recording head 21 (more strictly, the flexible flat cable 24 thereof, there is provided a clearance or space in which the flexible membrane 36 is allowed to deform. However, the recording head unit 3 may be modified to have a vertical nozzle-supporting surface. In this case, the buffer device 13 may be provided such that the primary partition wall 35 and the flexible membranes 36, 43 are substantially vertical.

Meanwhile, when the present ink jet printer (i.e., the ink jet recording apparatus) is shipped from a factory, the ink-tank-side fluid flow channels and the buffer chambers 27 are charged with a maintenance liquid, and the respective upstream-side ends of the ink supply tubes 14 that are to be connected to the ink tanks 5 are liquid-tightly closed with respective sealing members. The maintenance liquid may be a liquid having a composition that is basically identical with that of an ink but does not contain a coloring agent.

When a user purchases a new ink jet printer and starts use of the printer, i.e., when the user initially introduces the printer, the user needs to connect, according to a user's manual, the respective upstream-side ends of the ink supply tubes 14*a*, 14*b*, 14*c*, 14*d* to the ink tanks 5*a*, 5*b*, 5*c*, 5*d*, respectively, and operate the printer such that at the head waiting position where the maintenance unit 4, shown in FIGS. 1, 8A, and 18B, is provided, the large cap member 71 is moved upward to contact closely the nozzle supporting surface of the recording head 21, and the small cap members 72 are simultaneously moved upward to contact closely the lower end surface of the opening and closing valve device 26 where the four valve holes 56 open downward. Then, the control valve 75 is switched to cause the small cap members 72 to communicate with the suction pump 74, and the suction pump 74 is driven to suck respective amounts of the maintenance liquid present in the ink supply tubes 14 and the buffer chambers 27 via the fluid discharging passages 51 (51*a*, 51*b*, 51*c*, 51*d*) and the opening and closing valves 56, 57, and charge the tubes 14 and the chambers 27 with the corresponding color inks, without needing to cause the small cap members 72 to communicate with the recording head 21. Subsequently, usually, the switch or control valve 75 is switched to cause the large cap member 71 to communicate with the suction pump 74, and the suction pump 74 is driven to suck the maintenance liquid present in the recording head 21 via the nozzles 22, and charge the recording head 21 with the color inks.

Recently there has been a demand that when a full-color ink jet printer is used to record a monochromatic image, the image be recorded at a high speed. In view of this demand, it has been proposed to employ a recording head that ejects a greater amount of black ink per unit time than respective amounts of other color inks per unit time. In this case, the number of nozzles corresponding to the black ink is made greater than the number of nozzles corresponding to each of the other color inks, like in each of the illustrated embodiments. In addition, the cross-section area of the ink supply tube 14*a* corresponding to the black ink is made greater than the cross-section area of each of the other ink supply tubes 14*b*, 14*c*, 14*d* corresponding to the other color inks. That is, an amount per unit time of supplying of the black ink from the ink tank 5*a* to the buffer chamber 27*a* via the ink supply tube 14*a* is made greater than that of each of the other color inks from the ink tanks 5*b*, 5*c*, 5*d* to the buffer chambers 27*b*, 27*c*, 27*d* via the corresponding ink supply tubes 14*b*, 14*c*, 14*d*. Thus, it is assured that the full-color ink jet printer records the monochromatic image at the increased speeds.

In the case where respective lengths of the ink supply tubes 14 (14*a*, 14*b*, 14*c*, 14*d*) are equal to each other, respective amounts of the maintenance liquid present in the tubes 14 are in proportion to the respective cross-section areas of the same 14. Therefore, when the maintenance liquid is discharged, at the time of initial use of the ink jet printer, simultaneously via all the fluid discharging passages 51 and all the valve holes 56 of the opening and closing valve device 26, under a condition that respective amounts per unit time of discharging of the maintenance liquid through the fluid discharging passages 51 are equal to each other, the maintenance liquid is discharged from an ink supply tube having a smaller cross-section area, before the maintenance liquid is discharged from an ink supply tube having a greater cross-section area. That is, when the maintenance liquid has been replaced with a color ink in an ink supply tube having a smaller cross-section area, a certain amount of the maintenance liquid remains in an ink supply tube having a greater cross-section area. Therefore, when the maintenance liquid has been replaced with a color ink in the ink supply tube having the greater cross-section area, a certain amount of ink will have been uselessly discharged as waste ink from the ink supply tube having the smaller cross-section area.

Since even the full-color ink jet printer is often required to record a monochromatic image, the printer employs the black ink tank 5*a* that stores a greater amount of ink than the other ink tanks 5*b*, 5*c*, 5*d* do. Therefore, when the printer is initially used, respective amounts of the other color inks present in the other ink tanks 5*b*, 5*c*, 5*d*, i.e., respective amounts of the other color inks that can be used to record full-color images on recording sheets may be excessively decreased. This leads to increasing the running cost of the printer.

Hence, in each of the illustrated embodiments, the four ink-tank-side fluid flow channels that connect between the four ink tanks 5 and the four buffer tanks 27, respectively, and that include the four ink supply tubes 14, respectively, have different liquid flow resistances, respectively, and the four discharging-device-side fluid flow channels that connect between the four buffer tanks 27 and the suction pump 74, respectively, and that include the four fluid discharging passages 51 and the four valve holes 56, respectively, have different liquid flow resistances, respectively, such that a first one of the four discharging-device-side fluid flow channels that communicates with a first one of the ink-tank-side fluid flow channels has the liquid flow resistance smaller than that of a second one of the discharging-device-side fluid flow channels that communicates with a second one of the ink-tank-side fluid flow channels that has the liquid flow resistance greater than that of the first ink-tank-side fluid flow channel.

In each of the illustrated embodiments, the number of the nozzles 22 corresponding to the black ink (BK) is twice the number of the nozzles 22 corresponding to each of the other color inks (C, Y, M). Therefore, when the ink jet printer is operated in a normal recording mode, an amount per unit time of ejecting of the black ink from the nozzles 22 can be about twice an amount per unit time of ejecting of each of the other color inks from the nozzles 22. Therefore, a cross-section area, Abk, of an inner hole of the ink supply tube 14*a* corresponding to the black ink (BK) is made twice a cross-section area, Acl, of an inner hole of each of the other ink supply tubes 14*b*, 14*c*, 14*d* corresponding to the other color inks (C, Y, M), so that an ink flow amount per unit time, Qbk, (hereinafter, referred to as the ink flow amount Qbk) in the ink supply tube 14*a* corresponding to the black ink (BK) is made twice an ink flow amount per unit time, Qcl, (hereinafter, referred to as the ink flow amount Qcl) in each of the other ink supply tubes 14*b*, 14*c*, 14*d* corresponding to the other color inks (C, Y, M). In this case, a liquid flow resistance, Rbk, of the discharging-device-side fluid flow channel that corresponds to the black ink (BK) and includes the fluid discharging passage 51*a* starting with the discharging hole 53 communicating with the second buffer chamber 39*a*, and ending with the connection port 52*a* communicating with the corresponding valve hole 56, is made half a liquid flow resistance, Rcl, of each of the other discharging-device-side fluid flow channels that correspond to the other color inks (C, Y, M), respectively, and include the fluid discharging passages 51*b*, 51*c* 51*d*, respectively (i.e., 2×Rbk=Rcl).

According to Hagen-Poiseuille's law known in hydraulics, a difference of respective pressures at opposite ends of a pipe is equal to the product of a resistance and a flow amount. Therefore, in each of the illustrated embodiments, the product of the resistance and the flow amount with respect to the entire liquid flow channel between the black ink supply tube 14*a* and the corresponding fluid discharging passage 51*a* is made substantially equal to the product of the resistance and the flow amount with respect to each of the entire liquid flow channels between the cyan, yellow, and magenta ink supply tubes 14*b*, 14*c*, 14*d* and the corresponding fluid discharging passages 51*b*, 51*c*, 51*d*.

In each of the illustrated embodiments, it is assumed that the four ink supply tubes 14 have a same length, the four valve devices (i.e., the four valve holes 56, the four valve members 57, etc.) of the opening and closing valve device or unit 26 that correspond to the four color inks, respectively, have a same liquid flow resistance, and the suction pump 74 applies a same negative pressure to the maintenance liquid.

Figure 20:
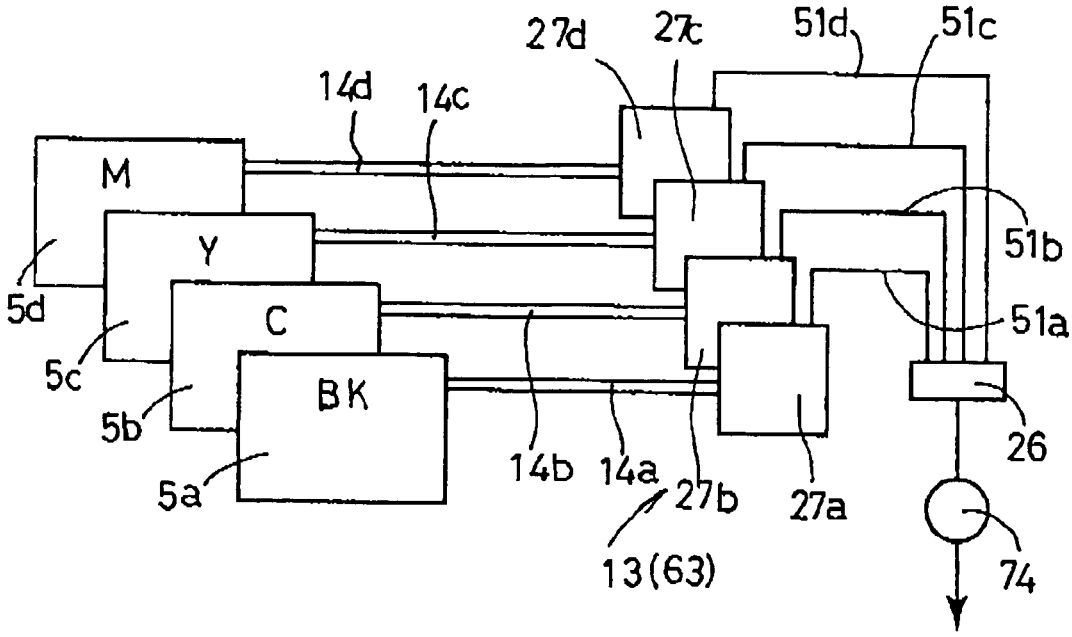
FIG. 20 is a diagrammatic view for explaining four ink flow channels that correspond to four color inks, respectively, and include four ink supply tubes respectively connected to four ink tanks; four buffer chambers; four fluid discharging passages; and four opening and closing valves connectable to a suction pump (i.e., a discharging pump)

The above-described structural features of the present ink jet printer allow a user who initially introduces the printer, to start simultaneously the respective operations of discharging the maintenance liquid from the black ink supply tube 14*a* and the other ink supply tubes 14*b*, 14*c*, 14*d*. More specifically described, since the amount per unit time of discharging of the maintenance liquid through the fluid discharging passage 51*a* corresponding to the black ink (BK) is twice the amount per unit time of discharging of the maintenance liquid through each of the fluid discharging passages 51*b*, 51*c*, 51*d* corresponding to the other color inks (C, Y, M), and the respective velocities of flowing of the maintenance liquid through the four fluid flow channels (see FIG. 20) that correspond to the four color inks, respectively, and extend from the ink supply tubes 14*a*, 14*b*, 14*c*, 14*d* to the fluid discharging passages 51*a*, 51*b*, 51*c*, 51*d* are equal to each other, the respective operations of replacing the maintenance liquid in all the ink supply tubes 14 (14*a*, 14*b*, 14*c*, 14*d*) and all the buffer chambers 27 (27*a*, 27*b*, 27*c*, 27*d*) with the corresponding color inks (BK, C, Y, M) can be ended simultaneously. Therefore, the present ink jet printer is freed of the problem of the conventional ink jet printer that the operation of replacing the maintenance liquid present in the black ink flow channel, with the black ink cannot be ended simultaneously when the respective operations of replacing the maintenance liquid in the other ink flow channels, with the other color inks are ended and accordingly respective certain amounts of the other color inks are uselessly discharged.

Regarding the above-indicated law that a difference of respective pressures at opposite ends of a pipe is equal to the product of a resistance and a flow amount, it is known that the resistance is in proportion to the length of the pipe and is in inverse proportion to the fourth power of a hydraulic radius of the pipe.

Therefore, in order that the liquid flow resistance Rbk of the fluid discharging passage 51*a* corresponding to the black ink (BK) may be made half the liquid flow resistance Rcl of each of the fluid discharging passages 51*b*, 51*c*, 51*d* corresponding to the other color inks (C, Y, M), i.e., in order to establish the following structural feature: 2×Rbk=Rcl, the length of the fluid discharging passage 51*a* is made smaller than that of each of the other fluid discharging passages 51*b*, 51*c*, 51*d*, and the hydraulic radius m, or the cross-section area, of the fluid discharging passage 51*a* {(the hydraulic radius m)=(cross-section area of flow passage)/(circumferential length of cross section of flow passage)} is made greater than that of each of the other fluid discharging passages 51*b*, 51*c*, 51*d*. In the case where the four fluid discharging passages 51*a*, 61*b*, 51*c*, 51*d* have respective rectangular transverse cross sections, and have a same width in its plan view, as shown in FIG. 18A, respective depths of the passages 51 are made different from each other. Since the liquid flow resistance of the fluid discharging passage 51*a* is made different from the liquid flow resistances of the other fluid discharging passages 51*b*, 51*c*, 51*d*, by making the depth of the passage 51*a* different from the depths of the other passages 51*b*, 51*c*, 51*d*, it is not needed to increase the plan-view area of the buffer device 13, 63. Thus, the ink jet printer can be produced in a small size.

In addition, the liquid flow resistance of the ink-tank-side fluid flow channel that is located between the black ink tank 5*a* and the buffer device 13, 63 and includes the black ink supply tube 14*a*, is made different from that of each of the other ink-tank-side fluid flow channels that are located between the other ink tanks 5*b*, 5*c*, 5*d* and the buffer device 13, 63 and include the other ink supply tubes 14*b*, 14*c*, 14*d*, respectively. Moreover, the respective liquid flow amounts per unit time of the four fluid discharging passages 51 are made different from each other, and the respective liquid flow amounts per unit time of the four ink supply tubes 14 are made different from each other. To this end, the respective lengths of the four ink supply tubes 14 corresponding to the four color inks are made equal to each other, and the respective cross-section areas of the four ink supply tubes 14 are made different from each other. The fluid discharging passage 51*a* corresponding to the black ink supply tube 14*a* may have the liquid flow amount per unit time greater than the liquid flow amount per unit time of each of the other fluid discharging passages 51*b*, 51*c*, 51*d* corresponding to the other ink supply tubes 14*b*, 14*c*, 14*d* that have the respective ink flow amounts per unit time smaller than the ink flow amount per unit time of the black ink supply tube 14*a*.

In addition, the carriage 9 carries not only the recording head 21 but also the buffer case 25. The buffer case 25 has the four buffer chambers 27 that correspond to the four color inks, respectively, are separated from each other, and communicate with the four ink supply tubes 14, respectively, and additionally has the four fluid discharging passages 51 communicating with the four valve holes 56 of the opening and closing valve device 26. Since the buffer case 25 incorporates the opening and closing valve device or unit 26 as an integral portion thereof, the carriage 9 carries a portion of the means needed to discharge the maintenance liquid charged in the ink supply tubes 14 and the buffer chambers 27 and charge the tubes 14 and the chambers 27 with the color inks, when the user initially uses the ink jet printer. Thus, the recording head unit 3 can be constructed in a reduced size. In particular, the four fluid discharging passages 51*a*, 51*b*, 51*c*, 51*d* are formed in the upper surface of the buffer case 25, such that the passages 51 open in the same direction as the direction in which the three first chambers 27*b*-1, 27*c*-1, 27*d*-1 of the buffer chambers 27*b*, 27*c*, 27*d* open. Therefore, the four fluid discharging passages 51*a*, 51*b*, 51*c*, 51*d* and the three first chambers 27*b*-1, 27*c*-1, 27*d*-1 can be simultaneously defined by adhering the single flexible membrane 43 to the upper end surface of the buffer case 25. This leads to reducing the production cost of the recording head unit 3.

In order to end simultaneously the respective operations of discharging the maintenance liquid from the four ink supply tubes 14 and the four buffer chambers 27 and charging the tubes 14 and the chambers 27 with the corresponding color inks, a summed liquid storage volume of a combination of the black ink supply tube 14*a* and the black ink buffer chamber 27*a* may be made greater than that of each of other combinations of the other ink supply tubes 14*b*, 14*c*, 14*d* and the corresponding buffer chambers 27*b*, 27*c*, 27*d*. In this case, the combination of the black ink supply tube 14*a* and the black ink buffer chamber 27*a* that communicates with the fluid discharging passages 51*a* has the summed ink storage volume greater than the summed ink storage volume of each of the other combinations corresponding to the other fluid discharging passages 51*b*, 51*c*, 51*d*, respectively, that have the respective liquid flow resistances greater than the liquid flow resistance of the fluid discharging passage 51*a*.

In each of the illustrated embodiments, it is possible to employ, in place of, or in addition to, the suction pump 74, a positive-pressure applying pump that applies a positive pressure to each of the four ink tanks 5 so as to push the respective color inks into the respective ink supply tubes 14 and thereby discharge the maintenance liquid from the tubes 14 through the opening and closing valve device 26. In this case, the positive-pressure applying pump functions as part of the discharging device.

As the maintenance liquid, one or more sorts of color inks that has or have a high stability may be used. In this case, when the user initially uses the ink jet printer, the color ink or inks used as the maintenance liquid is or are replaced with proper color inks supplied from the ink tanks 5.

Figure 21:
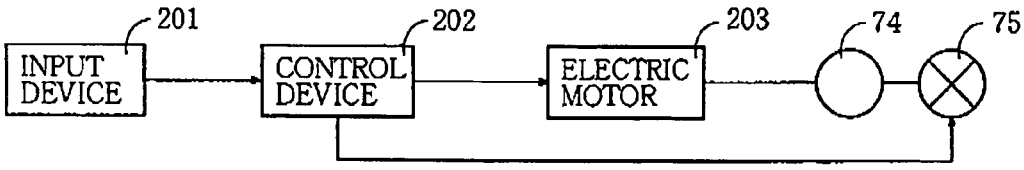
FIG. 21 is a diagrammatic view of a control system that is employed in each of the first and second embodiments of the present invention.

In each of the first and second embodiments, the ink jet printer employs a control system, shown in FIG. 21, including an input device 201 (e.g., a manually operable start switch) which is operable by a user to input, when he or she initially introduces the printer, a maintenance-liquid discharge command; an electric motor 203 which electrically drives or operates the suction pump 74; and a control device 202 which controls the switch or control valve 75 to selectively connect the suction pump 74 to the large cap 71 or the small caps 72, and additionally controls, based on the maintenance-liquid discharge command input through the input device 201, the electric motor 203 to drive the suction pump 74 for a pre-determined time duration. When the suction pump 74 is driven for the pre-determined time duration in the state in which the pump 74 is connected to the small caps 72, the operation of replacing the maintenance liquid charged in each of the buffer chambers 27 and the ink supply tubes 14 with a corresponding one of the color inks supplied from the ink tanks 5 can be simultaneously ended.

In each of the first and second embodiments, the ratio of the liquid flow amount per unit time of the discharging-device-side fluid flow channel corresponding to the black ink (BK) to the respective liquid flow amounts per unit time of the discharging-device-side fluid flow channels corresponding to the other color inks (C, Y, M) is substantially equal to the ratio of the liquid flow amount per unit time of the ink-tank-side fluid flow channel corresponding to the black ink to the respective liquid flow amounts per unit time of the other ink-tank-side fluid flow channels corresponding to the other color inks.

In each of the first and second embodiments, the ratio of the liquid flow resistance of the discharging-device-side fluid flow channel corresponding to the black ink (BK) to the respective liquid flow resistances of the other discharging-device-side fluid flow channels corresponding to the other color inks (C, Y, M) is substantially equal to an inverse number of the ratio of the liquid flow amount per unit time of the ink-tank-side fluid flow channel corresponding to the black ink to the respective liquid flow amounts per unit time of the ink-tank-side fluid flow channels corresponding to the other color inks.

In each of the first and second embodiments, the ratio of the cross-section area of the ink-tank-side fluid flow channel corresponding to the black ink (BK) to the respective cross-section areas of the other ink-tank-side fluid flow channels corresponding to the other color inks (C, Y, M) is substantially equal to the ratio of the nozzle number of the group (N4–N7) of nozzles 22 corresponding to the black ink to the respective nozzle numbers of the other groups (N1–N2; N3, N8; N9–N10) of nozzles 22 corresponding to the other color inks.

In each of the first and second embodiments, the when the suction pump 74 operates, for a pre-determined time duration, to discharge the maintenance liquid charged in each of respective combinations of the ink supply tubes 14*a*–14*d* and the corresponding buffer tanks 27*a*–27*d* into the outside space via a corresponding one of the fluid discharging passages 51*a*–51*d* and thereby replace the maintenance liquid with a corresponding one of the color inks (BK, C, Y, M) supplied from the ink tanks 5*a*–5*d*, more than 80% of an initial amount of the maintenance liquid charged in the each combination is replaced with the corresponding ink. More preferably, more than 90%, or most preferably, more than 95%, of the initial amount of the maintenance liquid charged in the each combination is replaced with the corresponding ink.

In each of the first and second embodiments, when the suction pump 74, 75 stops, after the pre-determined time duration, replacing the liquid in each of the above-indicated combinations 14*a*–14*d*, 27*a*–27*d* with the corresponding one of the inks, a proportion of the smallest one of the respective amounts of the maintenance liquid left in the combinations to the greatest one of the respective amounts is greater than about 50%, more preferably, more than 70%, or most preferably, more than 90%.

In each of the first and second embodiments, the four ink-tank-side fluid flow channels, the four buffer tanks 27, and the four discharging-device-side fluid flow channels cooperate with each other to provide four whole fluid flow channels which have respective liquid flow resistances different from each other, and the ratio of the liquid flow resistance of the whole fluid flow channel corresponding to the black ink (BK) to the respective liquid flow resistances of the other whole fluid flow channels corresponding to the other color inks (C, Y, M) is substantially equal to an inverse number of the ratio of the liquid storage volume of the combination of the black-ink tank-side fluid flow channel with the corresponding black-ink buffer tank 27*a* to the respective liquid storage volumes of the respective combinations of the other ink-tank-side fluid flow channels with the corresponding other buffer tanks 27*b*, 27*c*, 27*d*, or alternatively, equal to an inverse number of the ratio of the liquid storage volume of the whole fluid flow channel corresponding to the black ink to the respective liquid storage volumes of the other whole fluid flow channels.

It is to be understood that the present invention may be embodied with other changes and improvements that may occur to a person skilled in the art, without departing from the spirit and scope of the invention defined in the appended claims.

What is claimed is:

1. An ink jet recording apparatus, comprising:

a recording head which has a plurality of nozzles and which ejects, from each of the nozzles, a droplet of a corresponding one of a plurality of sorts of inks to form an image;

an ink-tank supporting portion which supports a plurality of ink tanks which store the inks, respectively, such that the ink tanks are stationary;

a plurality of ink-tank-side fluid flow channels which connect the ink tanks to the recording head, respectively, and include a plurality of ink supply tubes, respectively, which supply the inks from the ink tanks to the recording head, respectively, a plurality of buffer tanks which are provided between the ink supply tubes and the recording head and each of which accommodates a corresponding one of the inks, and air bubbles;

a discharging device which discharges a fluid from each of the buffer tanks into an outside space; and a plurality of discharging-device-side fluid flow channels which communicate, at respective one ends thereof with the buffer tanks, respectively, while bypassing the recording head, and communicate, at respective other ends thereof, with the discharging device, wherein said plurality of ink-tank-side fluid flow channels comprise first and second ink-tank-side fluid flow channels having respective first liquid flow resistances different from each other, wherein said plurality of discharging-device-side fluid flow channels comprise first and second discharging-device-side fluid flow channels having respective second liquid flow resistances different from each other, wherein the first discharging-device-side fluid flow channel that communicates with the first ink-tank-side fluid flow channel has the second liquid flow resistance smaller than the second liquid flow resistance of the second discharging-device-side fluid flow channel that communicates with the second ink-tank-side fluid flow channel that has the first liquid flow resistance greater than the first liquid flow resistance of the first ink-tank-side fluid flow channel.

2. The ink jet recording apparatus according to claim 1, wherein the first and second ink-tank-side fluid flow channels have respective first liquid flow amounts per unit time different from each other, and the first and second discharging-device-side fluid flow channels have respective second liquid flow amounts per unit time different from each other, and wherein a ratio of one of the respective second liquid flow amounts per unit time of the first and second discharging-device-side fluid flow channels to an other of said respective second liquid flow amounts per unit time is substantially equal to a ratio of a corresponding one of the respective first liquid flow amounts per unit time of the first and second ink-tank-side fluid flow channels to an other of said respective first liquid flow amounts per unit time.

3. The ink jet recording apparatus according to claim 1, wherein the first and second ink-tank-side fluid flow channels have respective liquid flow amounts per unit time different from each other, and wherein a ratio of one of the respective second liquid flow resistances of the first and second discharging-device-side fluid flow channels to an other of said respective second liquid flow resistances is substantially equal to an inverse number of a ratio of a corresponding one of the respective liquid flow amounts per unit time of the first and second ink-tank-side fluid flow channels to an other of said respective liquid flow amounts per unit time.

4. The ink jet recording apparatus according to claim 1, wherein the recording head has two groups of said nozzles which correspond to the first and second ink-tank-side fluid flow channels, respectively, and which include respective different numbers of nozzles from each other, wherein the first and second ink-tank-side fluid flow channels have a substantially equal length, and have respective cross-section areas different from each other, and wherein a ratio of one of the respective cross-section areas of the first and second ink-tank-side fluid flow channels to an other of said respective cross-section areas is substantially equal to a ratio of a corresponding one of the respective nozzle numbers of the two groups of nozzles to an other of said respective nozzle numbers.

5. The ink jet recording apparatus according to claim 1, further comprising:

a housing; and a carriage which is movable relative to the housing, wherein the discharging device comprises a plurality of opening and closing valves which communicate with respective upper portions of the buffer tanks via the discharging-device-side fluid flow channels, respectively, and each of which selectively opens or closes a corresponding one of the discharging-device-side fluid flow channels, so as to allow the fluid to be discharged from a corresponding one of the buffer tanks into the outside space, and wherein the recoding head, the buffer tanks, and the opening and closing valves are mounted on the carriage.

6. The ink jet recording apparatus according to claim 1, wherein the first and second ink-tank-side fluid flow channels have respective cross-section areas different from each other, and have respective first liquid flow amounts per unit time different from each other, wherein the first and second discharging-device-side fluid flow channels have respective second liquid flow amounts per unit time different from each other, and wherein the first discharging-device-side fluid flow channel that communicates with the first ink-tank-side fluid flow channel has the second liquid flow amount per unit time greater than the second liquid flow amount per unit time of the second discharging-device-side fluid flow channel that communicates with the second ink-tank-side fluid flow channel that has the first liquid flow amount per unit time smaller than the first liquid flow amount per unit time of the first ink-tank-side fluid flow channel.

7. The ink jet recording apparatus according to claim 1, wherein respective combinations of the first and second ink-tank-side fluid flow channels with the corresponding buffer tanks have respective summed liquid storage volumes different from each other, and wherein a first one of said combinations that communicates with the first discharging-device-side fluid flow channel has the summed liquid storage volume greater than the summed liquid storage volume of a second one of said combinations that communicates with the second discharging-device-side fluid flow channel that has the second liquid flow resistance greater than the second liquid flow resistance of the first discharging-device-side fluid flow channel.

8. The ink jet recording apparatus according to claim 7, wherein when the discharging device operates, for a predetermined time duration, to discharge a liquid charged in each of the first and second combinations into the outside space via a corresponding one of the first and second discharging-device-side fluid flow channels and thereby replace said liquid with a corresponding one of the inks supplied from the ink tanks, more than 80% of an initial amount of the liquid charged in said each combination is replaced with said corresponding ink.

9. The ink jet recording apparatus according to claim 8, further comprising:

an input device which is operable by a user to input a command to operate the discharging device to discharge the liquid from said each of the first and second combinations; and a control device which controls, based on the command inputted through the operation of the input device, the discharging device to start discharging the liquid from said each combination and stop, after the pre-determined time duration, replacing the liquid in said each combination with said corresponding ink.

10. The ink jet recording apparatus according to claim 8, wherein when the discharging device stops, after the predetermined time duration, replacing the liquid in said each of the first and second combinations with said corresponding ink, a proportion of a smaller one of respective amounts of the liquid left in the first and second combinations to a greater one of said respective amounts is greater than about 50%.

11. The ink jet recording apparatus according to claim 1, wherein the discharging device comprises a fluid suction pump to which the discharging-device-side fluid flow channels are connected in parallel with each other.

12. The ink jet recording apparatus according to claim 11, wherein the discharging device further comprises a control valve which selectively connects the fluid suction pump to the nozzles of the recording head, or the discharging-device-side fluid flow channels.

13. The ink jet recording apparatus according to claim 1, wherein each of the first and second ink-tank-side fluid flow channels, a corresponding one of the buffer tanks, and a corresponding one of the first and second discharging-device-side fluid flow channels cooperate with each other to provide a corresponding one of two whole fluid flow channels which have respective third liquid flow resistances different from each other, and wherein a ratio of one of the respective third liquid flow resistances of the two whole fluid flow channels to an other of said respective third liquid flow resistances is substantially equal to an inverse number of a ratio of a corresponding one of respective liquid storage volumes of respective combinations of the first and second ink-tank-side fluid flow channels with the corresponding buffer tanks to an other of said respective liquid storage volumes.

14. The ink jet recording apparatus according to claim 1, wherein each of the first and second ink-tank-side fluid flow channels, a corresponding one of the buffer tanks, and a corresponding one of the first and second discharging-device-side fluid flow channels cooperate with each other to provide a corresponding one of two whole fluid flow channels which have respective third liquid flow resistances different from each other, and wherein a ratio of one of the respective third liquid flow resistances of the two whole fluid flow channels to an other of said respective third liquid flow resistances is substantially equal to an inverse number of a ratio of a corresponding one of respective liquid storage volumes of the two whole fluid flow channels to an other of said respective liquid storage volumes.

15. Thee ink jet recording apparatus according to claim 1, wherein said plurality of ink tanks store, as said plurality of sorts of inks, a plurality of different color inks, respectively, which include a black ink and a different color ink from the black ink, and the recording head ejects, from said each of said plurality of nozzles, a droplet of a corresponding one of said plurality of different color inks, and wherein the black ink flows through the first ink-tank-side fluid flow channel and the first discharging-device-side fluid flow channel and the different color ink flows through the second ink-tank-side fluid flow channel and the second discharging-device-side fluid flow channel.

* * * * *